US011324342B2

(12) United States Patent
Asbury

(10) Patent No.: US 11,324,342 B2
(45) Date of Patent: May 10, 2022

(54) OBJECT HANGING SYSTEM AND METHOD

(71) Applicant: Harry Asbury, Holt, FL (US)

(72) Inventor: Harry Asbury, Holt, FL (US)

( * ) Notice: Subject to any disclaimer, the term of this patent is extended or adjusted under 35 U.S.C. 154(b) by 0 days.

(21) Appl. No.: 17/089,114

(22) Filed: Nov. 4, 2020

(65) Prior Publication Data

US 2021/0127862 A1 May 6, 2021

Related U.S. Application Data

(60) Provisional application No. 62/930,947, filed on Nov. 5, 2019.

(51) Int. Cl.
*A47G 1/16* (2006.01)

(52) U.S. Cl.
CPC ..... *A47G 1/1626* (2013.01)

(58) Field of Classification Search
CPC ..... A47G 1/1626
USPC .... 248/470, 466, 475.1, 476, 477, 497, 489, 248/544, 51, 542, 546; 33/613
See application file for complete search history.

(56) References Cited

U.S. PATENT DOCUMENTS 2,682,383 A * 6/1954 Horwitz ..... A47G 1/1626 248/495
2,943,831 A * 7/1960 Goss ..... A47G 1/1626 248/495
2,983,473 A * 5/1961 Waller ..... A47G 1/1626 248/495
4,549,713 A * 10/1985 Magadini ..... A47G 1/1686 248/125.1
4,557,455 A * 12/1985 Benjamin ..... B65D 63/1072 248/496
6,095,465 A * 8/2000 Week ..... A47G 1/20 248/205.3
6,651,945 B2 11/2003 Rivellino
6,672,551 B2 1/2004 Rivellino
8,308,122 B1 * 11/2012 Wadia ..... A47G 1/20 248/475.1
8,672,286 B2 * 3/2014 Darre ..... A47G 1/164 248/477
8,820,696 B1 * 9/2014 Wadia ..... A47G 1/20 248/476
10,278,524 B2 * 5/2019 Greve ..... A47G 1/164
10,477,995 B2 * 11/2019 Lervik ..... A47G 1/164
2002/0179803 A1 * 12/2002 Hayde ..... A47G 1/1666 248/489

(Continued)

*Primary Examiner* — Kimberly T Wood
(74) *Attorney, Agent, or Firm* — Christopher A. Proskey; BrownWinick Law Firm

(57) ABSTRACT

A system is presented for connecting a wall hanging object the support surface such as wall. The system has an attachment member that is attached to the wall surface by using one or more fastening techniques such as adhesive, tape or mechanical fastener. The mounting bracket has hook and opening guide path positioned within or along the hook. Wherein, a flexible member such as elongated rod is connected to the opening guide formed in the hook of the mounting bracket. Further, the flexible member or rod has two ends such as head and tip that allows the flexible member or rod to slide between fully extended and retracted position. In the extended position, the flexible member or rod helps to connect with the hanger or loops of the object or picture frame and later guides the hanger of the object to fit over the hook of the mounting bracket.

38 Claims, 24 Drawing Sheets

(56) References Cited

U.S. PATENT DOCUMENTS

| | | | | |
|---|---|---|---|---|
| 2005/0218287 | A1* | 10/2005 | Strobel | A47G 1/205<br>248/476 |
| 2010/0096532 | A1* | 4/2010 | Greve | A47G 1/202<br>248/477 |
| 2010/0219323 | A1* | 9/2010 | Ernst | A47G 1/20<br>248/475.1 |
| 2015/0320242 | A1* | 11/2015 | Potgieter | A47G 1/1626<br>248/477 |

* cited by examiner

OBJECT HANGING SYSTEM AND METHOD

CROSS REFERENCE TO RELATED APPLICATION

This application claims priority to U.S. Provisional Application No. 62/930,947 which was filed on Nov. 5, 2019, the entirety of which is incorporated herein fully by reference.

FIELD OF THE DISCLOSURE

This disclosure relates to hanging objects, such as picture frames, shadow boxes, mirrors, or any other type of hanging object. More specifically and without limitation, this disclosure relates to an object hanging system and method of use for installing a picture frame, shadow box, mirror or any other hanging object to any supporting surface such as a wall.

OVERVIEW OF THE DISCLOSURE

It is common practice for people to hang items such as picture frames, shadow boxes, mirrors, and other functional and/or decorative items on walls. A variety of wall hanging devices have been previously designed for the purpose of hanging picture frames and other items on the walls and other vertical surfaces. Standard picture hangers typically are formed pieces of metal mounted to a wall by one or more nails and that include a hook member on which a picture frame is supported. In many cases, a hanger such as a wire extending across the rear side of a picture frame or a small ring or loop is connected to the picture frame is placed over the hook of the picture frame hanger. Once the hanger is placed over the hook of the picture frame hanger, the picture frame hangs from and is supported by the hook of the picture frame hanger.

One of the objectives of conventional picture frame hangers is that they are to be as low-profile as possible so as to hold a picture frame in as upright an alignment as possible. This low-profile nature causes the hook of the picture frame hanger to protrude only a minimal distance from the wall that it is attached to. A common problem associated with standard picture hangers is that it is difficult, and some cases almost impossible, to get the hanger, such as the wire or ring or loop, placed over the hook of the picture frame hanger. This can be extremely frustrating not to mention time consuming. In addition, if the hanger is not securely installed onto the hook of the picture frame hanger the picture frame can fall off of the picture frame hanger causing damage and/or injury.

Therefore, for all the reasons stated above, and the reasons stated below, there is a need in the art for an improved object hanging system for connecting hanging objects such as a picture frame, shadow box, mirror or any other hanging object to vertical surfaces such as walls in a faster, easier and safer manner with less frustration and with less guesswork.

Thus, it is a primary object of the disclosure to provide an object hanging system that improves upon the state of the art.

Another object of the disclosure is to provide an object hanging system that allows secure mounting of objects to a supporting surface.

Yet another object of the disclosure is to provide an object hanging system that reduces installation time.

Another object of the disclosure is to provide an object hanging system that allows quick installation.

Yet another object of the disclosure is to provide an object hanging system that prevents damage due to improper installation of wall hanging objects.

Another object of the disclosure is to provide an object hanging system that prevents injury due to improper installation of wall hanging objects.

Yet another object of the disclosure is to provide an object hanging system that is easy to use.

Another object of the disclosure is to provide an object hanging system that is cost effective.

Yet another object of the disclosure is to provide an object hanging system that is inexpensive.

Another object of the disclosure is to provide an object hanging system that is intuitive to use.

Yet another object of the disclosure is to provide an object hanging system that can be used with practically any hanging object.

Another object of the disclosure is to provide an object hanging system that eliminates guesswork when installing hanging objects to a wall.

Yet another object of the disclosure is to provide an object hanging system that is safer than presently available alternatives.

Another object of the disclosure is to provide an object hanging system that is robust.

Yet another object of the disclosure is to provide an object hanging system that has a long useful life.

Another object of the disclosure is to provide an object hanging system that can be used multiple times.

Yet another object of the disclosure is to provide an object hanging system that is fully concealed behind the hanging object.

Another object of the disclosure is to provide an object hanging system that is adjustable in nature.

These and other objects, features, or advantages of the present disclosure will become apparent from the specification, claims and drawings.

SUMMARY OF THE DISCLOSURE

A system of connecting a wall hanging object such as picture frame to the support surface such as a wall, the object hanging system has an attachment member such as a mounting bracket that is attached to the wall surface by using one or more fastening techniques such as adhesive, tape or mechanical fastener. The mounting bracket that is attached to the wall surface has hook and opening guide path positioned within or along the hook. Wherein, a flexible member such as elongated rod is connected to the opening guide formed in the hook of the mounting bracket. Further, the flexible member or rod that consists two ends such as head and tip allows the flexible member or rod to slide between fully extended and retracted position. During extended position the flexible member or rod helps to connect with the hanger or loops of the object or picture frame and later guides the hanger of the object to fit over the hook of the mounting bracket. This system provides the advantage of forming a reliable, efficient and time saving installation procedure of mounting an object such as picture frame to the vertical surface such as wall.

DETAILED DESCRIPTION OF THE DISCLOSURE

Figure 1:
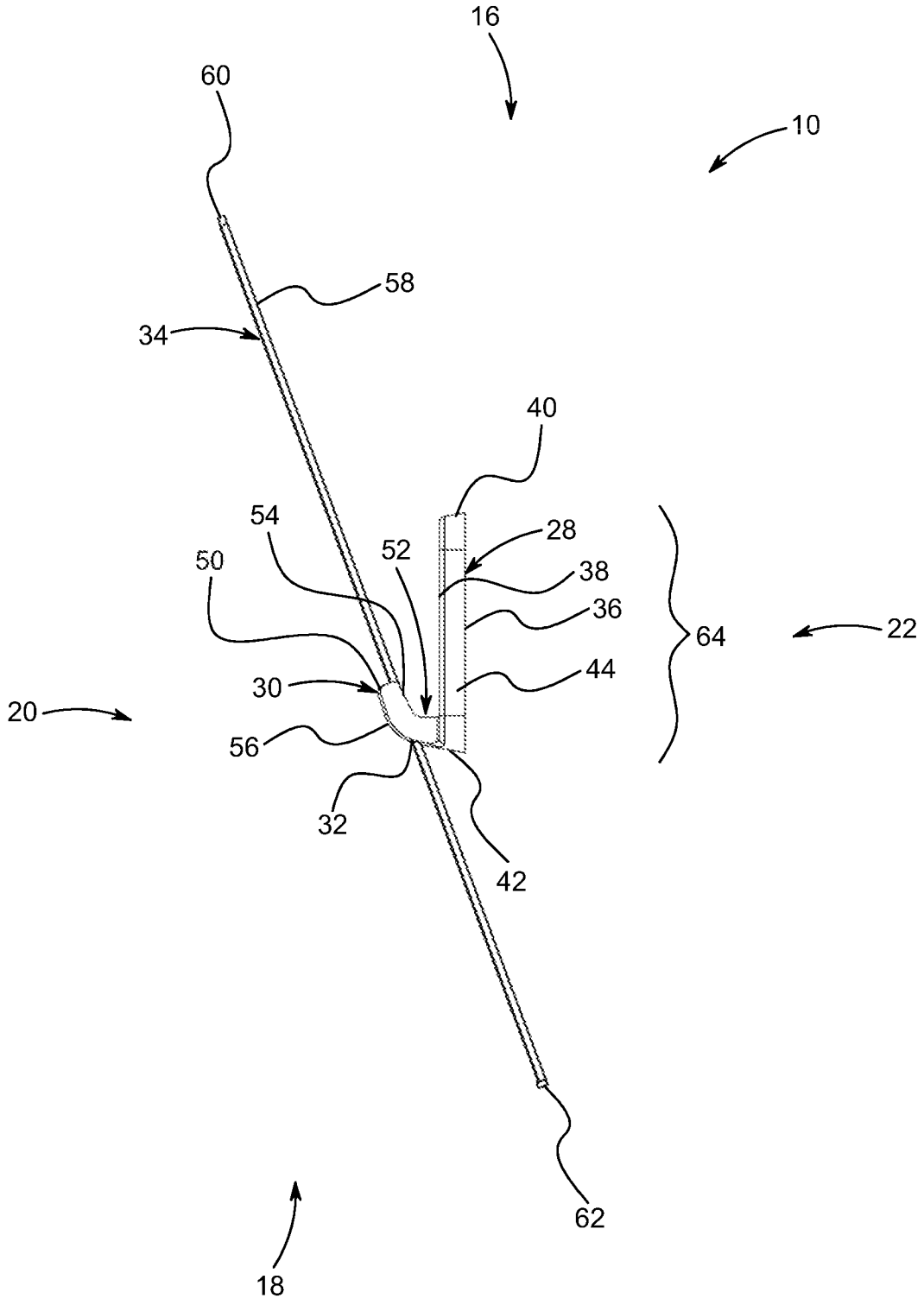
FIG. 1 shows a left side view of an object hanging system, in accordance with one or more embodiments.

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation or configuration.

As used herein, the term "or" includes one or more of the associated listed items, such that "A or B" means "either A or B". As used herein, the term "and" includes all combinations of one or more of the associated listed items, such that "A and B" means "A as well as B." The use of "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of hanging of objects on walls. However, the embodiments are not so limited. It is appreciated that the embodiments may be adapted for use for supporting of various other objects in various other applications. The support system is merely shown and described as being used in the context of hanging objects on wall for ease of description and as one of countless examples.

Object Hanging System 10:

With reference to the figures, an object hanging system 10 (system 10) is presented. Object hanging system 10 is formed of any suitable size, shape and design and is configured to facilitate the quick, easy and safe installation of a hanging object 12 (such as a picture frame, shadow box, mirror, or any other hanging object) onto a wall 14. In the arrangement shown, as one example, object hanging system 10 includes a top side 16, a bottom side 18, a front side 20, a rear side 22 and opposing sides 24 (left side and right side).

Hanging Object 12:

In the arrangement shown, as one example, object hanging system 10 is used in association with a hanging object 12. Hanging object 12 is formed of any suitable size, shape and design. Hanging object 12 may be formed of a picture frame, a shadow box, a mirror, any decorative item, or any other hanging object. In the arrangement shown, as one example, hanging object 12 is formed of a picture frame. However, this is only one of countless examples and is not intended to be limiting.

In the arrangement shown, as one example, hanging object 12, which in this example, is a picture frame, includes one or more hangers 26. Hangers 26 are formed of any suitable size, shape and design and are configured to facilitate attachment of hanging object 12 to a hanging device. In the arrangement shown, as one example, hanging object 12, which is shown as a picture frame, has one or more hangers 26 in the rear side of the hanging object 12 that are formed of small rings or loops. However, it is hereby contemplated that hanger 26 may be formed of a wire extending across all or a portion of the rear side of the hanging object 12, or a claw that is configured to engage a fastener or hook, multiple hooks or fasteners, or any other object or structure that is configured to facilitate hanging of the hanging object 12.

In the arrangement shown, as one example, where hanger 26 is a small ring or loop attached directly to the rear side of the hanging object it is extremely difficult to hang the hanger on a hook of a fastener or hook attached to wall 14. Object hanging system 10 resolves this issue by making it easier to hang a hanging object 12 using a wall attachment member 28 having a hook member 30, a guide opening 32 and a flexible member 34.

Wall Attachment Member 28:

In the arrangement shown, as one example, object hanging system 10 includes a wall attachment member 28. Wall attachment member 28 is formed of any suitable size, shape and design and is configured to facilitate attachment of object hanging system 10 to wall 14.

In the arrangement shown, as one example, wall attachment member 28 serves as the main body or main structural member of object hanging system 10 and includes a rear side 36, a front side 38, an upper end 40, a lower end 42 and opposing sides 44.

In the arrangement shown, as one example, rear side 36 of wall attachment member 28 is generally flat and straight and planar in shape which serves to engage a flat and straight and planar wall in flat and flush engagement so as to maximize surface area of engagement. However, any other size, shape and design is hereby contemplated for use.

In the arrangement shown, as one example, front side 38 of wall attachment member 28 is generally flat and straight and planar in shape. However, any other size, shape and design is hereby contemplated for use.

In the arrangement shown, as one example, rear side 36 and front side 38 extend in approximate parallel planar spaced alignment to one another.

In the arrangement shown, as one example, upper end 40 of wall attachment member 28, when viewed from the front side 20 or rear side 22 is formed of a generally curved or rounded surface. However, any other size, shape and design is hereby contemplated for use.

In the arrangement shown, as one example, lower end 42 of wall attachment member 28, when viewed from the front side 20 or rear side 22 is formed of a generally curved or rounded surface. However, any other size, shape and design is hereby contemplated for use.

In the arrangement shown, as one example, opposing upper end 40 and lower end 42 when viewed from the front side 20 or rear side 22 are formed of similar but opposite rounded shapes thereby giving the top side 16 and bottom side 18 of wall attachment member 28 a similar shape. In the arrangement shown, as one example, upper end 40 and lower end 42 of wall attachment member 28 are formed of a half-circular shape when viewed from the front side 20 or rear side 22. This rounded shape eliminates sharp edges or corners that hanging object or other objects could catch on. As an example, if the hanger 26 of hanging object 12 engaged the upper end 40 of wall attachment member 28 the curved shape of would help guide the hanger 26 downward and off of the upper end 40 of wall attachment member 28 and toward hook member 30. However, any other size, shape and design is hereby contemplated for use.

In the arrangement shown, as one example, opposing sides 44 of wall attachment member 28 are generally flat and straight and planar in shape. However, any other size, shape and design is hereby contemplated for use. In the arrangement shown, as one example, opposing sides 44 extend in approximate parallel spaced alignment to one another. However, any other size, shape and design is hereby contemplated for use.

In the arrangement shown, as one example, opposing sides 44 connect at their rear side to the outward sides of rear side 36 and connect at their forward side to the outward sides of front side 38 of wall attachment member 28. In the arrangement shown, as one example, opposing sides 44 angle inward toward one another slightly as they extend from rear side 36 to front side 38 which causes the front side 38 of wall attachment member 28 to be slightly smaller than the rear side 36 of wall attachment member 28. Similarly, in the arrangement shown, as one example, upper end 40 and lower end 42 of wall attachment member 28 angle inward toward one another slightly as they extend from rear side 36 to front side 38 which causes the front side 38 of wall attachment member 28 to be slightly smaller than the rear side 36 of wall attachment member 28.

In the arrangement shown, as one example, the intersection of the outward edge of front side 38 of wall attachment member 28 with the forward edges of upper end 40, lower end 42 and opposing sides 44 is rounded, curved, angled, chamfered or otherwise smoothed. This rounded shape eliminates sharp edges or corners that hanging object 12 or other objects could catch on. As an example, if the hanger 26 of hanging object 12 engaged the front edge of front side 38 of wall attachment member 28 the curved shape of the intersection of the outward edge of front side 38 of wall attachment member 28 with the forward edges of upper end 40 would help guide the hanger 26 off of front side 38 of wall attachment member 28 and potentially toward hook member 30. However, any other size, shape and design is hereby contemplated for use.

In the arrangement shown, as one example, wall attachment member 28 includes one or more openings 46. Openings 46 are formed of any suitable size, shape and design and are configured to extend through wall attachment member 28 and are configured to receive a fastener 48 therein. In the arrangement shown, as one example, opening 46 is a generally circular or cylindrical shaped opening positioned near the upper center of wall attachment member 28.

Fastener 48 is formed of any suitable size shape and design and is configured to facilitate attachment of object hanging system 10 to wall 14 by puncturing wall 14. Fastener 48 may be formed of a screw, bolt, nail, tack, anchor or any other fastening device. In one arrangement, object hanging system 10 is installed onto wall 14 by placing the rear side 36 of wall attachment member 28 onto wall 14 at the desired position followed by the insertion of fastener 48 through opening 46 and into wall 14 thereby mechanically affixing object hanging system 10 to wall 14.

In the arrangement shown, as one example, wall attachment member 28 includes a hook member 30.

Hook Member 30:

In the arrangement shown, as one example, object hanging system 10, or more specifically, wall attachment member 28, includes a hook member 30. Hook member 30 is formed of any suitable size, shape and design and is configured receive hanger 26 of hanging object 12 thereon so as to support the hanging of hanging object 12 from object hanging system 10.

In the arrangement shown, as one example, hook member 30 is a generally curved member that connects at its lower end adjacent the lower front side 38 of wall attachment member 28 in a generally centrally positioned location. In the arrangement shown, as one example, hook member 30 extends outward from wall attachment member 28 as hook member 30 extends upward before terminating in an end 50 at the upper forward end of hook member 30. It is hereby contemplated that hook member 30 may extend outward from wall attachment member 28 in a straight manner, in a curved manner, or in sections with a combination of a straight extension as well as a curved extension.

In the arrangement shown, as one example, hook member 30 forms a receiving space 52 positioned between the end 50 of hook member 30 and the front side 38 of wall attachment member 28. Receiving space 52 is configured to receive and hold hanger 26 of hanging object 12 therein under the force of gravity. In this arrangement, when hanger 26 is positioned within receiving space 52, hanger 26 engages and rests upon the upper surface 54 of hook member 30 between end 50 and front side 38 of wall attachment member 28. Hook member 30 also includes a lower surface 56 which is opposite upper surface 54.

In the arrangement shown, as one example, the intersection of front side 38 of wall attachment member 28 and the rearward lower end of hook member 30 is rounded, curved, angled, chamfered or otherwise smoothed. This rounded shape eliminates sharp edges or corners that hanging object 12 or other objects could catch on. This rounded shape also improves strength as it eliminates sharp corners that could lead to crack propagation. However, any other size, shape and design is hereby contemplated for use. As an example, if the hanger 26 engaged the edge of the rearward lower end of hook member 30 the curved shape of the intersection of front side 38 of wall attachment member 28 and the rearward lower end of hook member 30 would help guide the hanger 26 off the edge of the rearward lower end of hook member 30 and potentially toward receiving space 52. However, any other size, shape and design is hereby contemplated for use.

In the arrangement shown, as one example, wall attachment member 28, or more specifically hook member 30 includes a guide opening 32.

Guide Opening 32:

In the arrangement shown, as one example, object hanging system 10, or more specifically, hook member 30 includes a guide opening 32. Guide opening 32 is formed of any suitable size, shape and design and is configured to facilitate the attachment of flexible member 34 to object hanging system 10.

In the arrangement shown, as one example, guide opening 32 is an opening that extends through hook member 30 and receives flexible member 34 therein. In the arrangement shown, as one example, opening 32 extends through the lower surface 56 of hook member 30 and through the upper surface 54 and/or the end 50 of hook member 30. In this way, guide opening 32 provides a passageway through hook member 30 for flexible member 34.

In the arrangement shown, as one example, guide opening 32 extends forward as guide opening 32 extends upward. This forward and upward angular arrangement for guide opening 32 imparts an upward and outward angular alignment to flexible member 34.

In the arrangement shown, as one example, the upper end of guide opening 32 intersects with hook member 30 in such a way, that when viewed from the side, there is no lip that hanger 26 of hanging object 12 could get hung up on when it is slid down flexible member 34 and into receiving space 52. This ensures complete insertion of hanger 26 into receiving space 52 and onto hook member 30.

In the arrangement shown, as one example, guide opening 32 is sized and shaped to receive the exterior surface of flexible member 34 therein with close and tight tolerances that allow flexible member 34 to slide there through while imparting enough friction to hold flexible member 34 in place, in a rest position, at any position between a fully extended position and a fully retracted position.

Flexible Member 34:

In the arrangement shown, as one example, object hanging system 10, or more specifically, hook member 30 includes a flexible member 34. Flexible member 34 is formed of any suitable size, shape and design and is configured to help guide hanger 26 of hanging object 12 over hook member 30 during installation of hanging object 12 onto object hanging system 10.

In the arrangement shown, as one example, flexible member 34 is formed of a corresponding size and shape to fit within the hollow interior of guide opening 32 with close and tight tolerances that allow flexible member 34 to slide through guide opening 32 while imparting enough friction to hold flexible member 34 in place, in a rest position, at any position between a fully extended position and a fully retracted position. Alternatively, in one or more arrangements, flexible member 34 may be oriented to make frictional contact with the wall sufficient to hold flexible member in place, in a rest position, at any position between the fully extended position and the fully retracted position.

In the arrangement shown, as one example, flexible member 34 includes a body 58 that extends a length between a tip 60 and a head 62. In the arrangement shown, as one example, when guide opening 32 is generally square or rectangular in cross-sectional shape the body 58 of flexible member 34 is generally square or rectangular in cross-sectional shape. However, embodiments are not so limited. Rather it is contemplated that in one or more arrangements, guide opening 32 and body 58 may have any other shape including but not limited to circle, triangle, hexagon, octagon, and/or any other polygon or shape. Similarly, in one arrangement shown, as one example, when guide opening 32 is generally circular or oval in cross-sectional shape the body 58 of flexible member 34 is generally circular or oval in cross-sectional shape. Any other configuration or shape is hereby contemplated for use as the corresponding but opposite shape of guide opening 32 and body 58 of flexible member 34. In the arrangement shown, as one example, body 58 of flexible member 34 is generally continuous in size and shape from tip 60 to head 62.

In the arrangement shown, as one example, tip 60 of flexible member 34 is a generally rounded or pointed end. The rounded or pointed end that forms tip 60 helps to facilitate the insertion of tip 60 into and through guide opening 32. However, any other size, shape or design is hereby contemplated for use.

In the arrangement shown, as one example, head 62 of flexible member 34 is a generally oversized end. The generally oversized end that forms head 62 helps to stop head 62 from being pulled through guide opening 32. That is, in the arrangement shown, as one example, head 62 is larger than guide opening 32. As such, when flexible member 34 is pulled upward, and the head 62 engages the lower surface 56 of hook member 30, flexible member 34 is in a fully extended position.

In contrast, when flexible member 34 is pulled downward, tip 60 can be pulled through guide opening 32 facilitating the complete removal of flexible member 34 from hook member 30 and guide opening 32. When flexible member 34 is pulled all the way downward, while still engaging guide opening 32 of hook member 30, flexible member 34 is in a fully retracted position.

Guide member 32 is configured to impart enough friction upon the body 58 of flexible member 34 to allow flexible member 34 to slide through guide opening 32 between a fully retracted position and a fully extended position. Guide member 32 is configured to impart enough friction upon the body 58 of flexible member 34 to hold flexible member 34 at any position between a fully retracted position and a fully extended position, which is known as a rest position.

In the arrangement shown, as one example, tip 60 is positioned on the upper side of hook member 30 and head 62 is positioned on the lower side of hook member 30. This allows flexible member 34 to be pulled upward to a fully extended position without being pulled through guide opening 32 so as to facilitate easy installation of hanger 26 of hanging object 12 on hook member 30. This arrangement also facilitates easy retraction of flexible member 34 to the retracted position or complete removal of flexible member 34 once hanging object 12 is installed onto hook member 30 by pulling head 62 downward until flexible member 34 is fully hidden behind hanging object 12 or until flexible member 34 is removed from hook member 30.

In an alternative arrangement, a head 62 is positioned at both ends of flexible member 34 thereby preventing the removal of flexible member 34 from guide opening 32.

In an alternative arrangement, a tip 60 is positioned at both ends of flexible member 34 thereby allowing the removal of flexible member 34 from either the upper side or lower side of guide opening 32.

In one arrangement, rear side 36 of wall attachment member 28 includes an adhesive member 64.

Adhesive Member 64:

In the arrangement shown, as one example, object hanging system 10 is used in association with an adhesive member 64. Adhesive member 64 is formed of any suitable size, shape and design and is configured to help facilitate installation of object hanging system 10 to wall 14 through adhesion.

In the arrangement shown, as one example, adhesive member 64 is attached to rear side 36 of wall attachment member 28. However, any other placement is hereby contemplated for use. Adhesive member 64 may cover all or a portion of rear side 36 of wall attachment member 28. Adhesive member 64 may be a single continuous and monolithic piece or a single continuous and monolithic layer. Alternatively, adhesive member 64 may be formed of a plurality of pieces or components applied to the rear side 36 of wall attachment member 28.

Adhesive member 64 may be formed of any form of an adhesive device, system or component such as a layer of glue, a layer of two-sided tape, a layer of two-sided adhesive foam, a layer of adhesive gel, pressure sensitive adhesives (e.g., Tesa® Powerstrips® from tesa AG, 3M Command® Adhesive Strips from 3M, and/or Plastofix® Formule Force 1000 Adhesive Strips from Plasto S.A.) or any other form of an adhesive device, system or component.

In one arrangement, adhesive member 64 is formed of or includes a compressible material, such as a compressible layer of foam or gel or the like, that accommodates variations in the surface of wall 14 thereby facilitating a stronger hold on wall 14.

In one arrangement, adhesive member 64 is not necessarily configured to adhere to wall 14. Instead, in this arrangement, adhesive member 64 is formed of a somewhat compressible material that has a high coefficient of friction that helps to prevent object hanging system 10 from sliding down wall 14. In this arrangement, object hanging system 10 is attached to wall 14 by way of inserting fastener 48 into wall 14 and the high coefficient of friction material that forms adhesive member 64 helps to prevent sliding of object hanging system 10 along wall 14.

In the arrangement shown, as one example, an adhesive member 64 may be used independently to affix object hanging system 10 to wall 14. Alternatively, fastener 48 may be used independently to affix object hanging system 10 to wall 14. Alternatively, both adhesive member 64 and fastener 48 may be used to affix object hanging system 10 to wall 14. This dual-method of attachment provides additional strength of hold and security for object hanging system 10.

Materials:

In the arrangement shown, as one example, object hanging system 10 may be formed of any suitable material. In one arrangement, wall attachment member 28 and attached hook member 30 are formed of a single monolithic and unitary continuous member formed of a single type of material such as a plastic, composite, ultra-high molecular weight material (UHMW) a fiberglass, a nylon, a rubber or any other non-metallic material that is strong enough to meet the needs of object hanging system 10. In an alternative arrangement, wall attachment member 28 and attached hook member 30 are formed of a single monolithic and unitary continuous member formed of a metallic material such as aluminum, steel, iron, brass, or any other metallic material or alloy or the like. In yet another alternative arrangement, wall attachment member 28 and attached hook member 30, may be formed of a combination of metallic materials and non-metallic materials, such as, for example, being formed primarily of plastic but having a metallic insert that strengthens hook member 30 and wall attachment member 28.

In one arrangement, hook member 30, or more specifically, upper surface 54 of hook member 30, includes a layer of material that has a high coefficient of friction. This layer of material that has a high coefficient of friction helps to hold hanger 26 of hanging object 12 onto hook member 30 once installed thereon. This can help prevent hanging object 12 from falling off of hook member 30.

Similarly, in the arrangement shown, as one example, flexible member 34 may be formed of a single monolithic and unitary continuous member formed of a single type of material such as a plastic, composite, ultra-high molecular weight material (UHMW) a fiberglass, a nylon, a rubber or any other non-metallic material that is strong enough to meet the needs of object hanging system 10 and allows for bending and flexibility of flexible member 34 so as to facilitate use. In an alternative arrangement, flexible member 34 may be formed of a single monolithic and unitary continuous member formed of a metallic material such as aluminum, steel, iron, brass, or any other metallic material or alloy or the like that similarly allows for bending and flexibility. In yet another alternative arrangement, flexible member 34 may be formed of a combination of metallic materials and non-metallic materials, such as, for example, being formed primarily of plastic but having a metallic insert that strengthens flexible member 34.

In Operation:

In the arrangement shown, as one example, object hanging system 10 is used in the following manner.

First, the location of the object hanging system 10 is determined on wall 14 or other vertical hanging support.

Next, the object hanging system 10 is attached to wall 14.

When object hanging system 10 is an adhesively attached to wall 14, the adhesive member 64 activated and adhered to wall 14. When adhesive member 64 is a glue or other adhesive, that adhesive is applied to the rear side 36 of wall attachment member 28 and then the rear side 36 of wall attachment member 28 is adhered to wall 14. Alternatively, when adhesive member 64 is layer of glue, adhesive gel, adhesive tape, adhesive foam or any other form of an adhesive that is covered by a removable protective cover, the protective cover is removed and then the rear side 36 of wall attachment member 28 is adhered to wall 14. In this way, object hanging system 10 is affixed to wall 14.

When object hanging system 10 is attached to wall 14 using fastener 48, the rear side 36 of wall attachment member 28 is placed against wall 14. Next, fastener 48 is inserted through opening 46 of wall attachment member 28 and into wall 14. This may be accomplished by screwing or hammering or pushing or any other mechanical process. Fastener 48 is inserted all the way into object hanging system 10 and wall 14 until the outward end or head of fastener 48 is flush, or nearly flush, with and/or inserted within a recess in front side 38 of wall attachment member 28. In this way, object hanging system 10 is affixed to wall 14.

When object hanging system 10 is both adhesively attached to wall 14 as well as fastened to wall 14, both of the above-identified processes are performed. First the adhesive member 64 is adhered to wall 14. Then the fastener 48 is inserted into wall 14. This arrangement provides the benefits of both the adhesive member 64 as well as use of the fastener 48. That is, use of the adhesive member 64 allows the object hanging system 10 to be precisely positioned on wall 14 without any other tools. Then, once object hanging system 10 is installed and in place, fastener 48 is inserted which provides a strong, durable and robust attachment to wall 14.

Next, now that the object hanging system 10 is installed on wall 14, hanging object 12 may be installed onto object hanging system 10.

First, if flexible member 34 is not inserted into guide opening 32, then tip 60 of flexible member 34 is inserted from the lower surface 56 of hook member 30 upward and into guide opening 32. Next, flexible member 34 is forced upward within guide opening 32 either by pushing head 62 or a portion of body 58 upward, or by pulling tip 60 or a portion of body 58 upward. This upward movement occurs with greater force than the force of friction between guide opening 32 and flexible member 34.

This upward movement of flexible member 34 continues until the desired position of flexible member 34 is achieved (a rest position which is any stopping point between a fully extended position and a fully retracted position). In this rest position an adequate amount of flexible member 34 extends upward from hook member 30.

Alternatively, this upward movement of flexible member 34 continues until flexible member 34 is moved to the fully extended position. In this fully extended position, the maximum amount of flexible member 34 is positioned above hook member 30. In this fully extended position, the head 62 is in engagement with the lower surface 56 of hook member 30, which prevents the lower end of flexible member 34 from pulling through guide opening 32.

Once flexible member 34 is sufficiently pulled upward within guide opening 32, either at the fully extended position or at an upwardly projecting rest position, the flexible member 34 provides increased room or area in which to maneuver and place the hanger 26 of hanging object 12 there over. In this position, the tip 60 of flexible member 34 is inserted through hanger 26 of hanging object 12. This may be a wire extending across the rear side of a picture frame or other hanging object 12, a small ring or loop connected to the rear side of a picture frame or other hanging object 12, or any other device which facilitates hanging of hanging object 12.

Once the tip 60 of flexible member 34 is inserted through hanger 26 of hanging object 12, hanging object 12 is carefully lowered onto hook member 30. As hanging object 12 is lowered, hanger 26 slides over flexible member 34 which guides hanger 26 toward hook member 30. As hanging object 12 is lowered, and hanger 26 approaches hook member 30, flexible member 34 guides hanger 26 past the upper end 50 of hook member 30. Hanger 26 then moves into the receiving space 52 between the front side 38 of wall attachment member 28 and the upper surface 54 of hook member 30.

As hanging object 12 transitions from sliding over flexible member 34 to hook member 30 one benefit of the object hanging system 10 is that there is a smooth transition from flexible member 34 to hook member 30. That is, there is no lip or edge or other feature or obstruction between flexible member 34 and the upper inward end 50 of hook member 30. In this way, when hanger 26 of hanging object 12 is lowered onto hook member 30 nothing stops hanger 26 from entering receiving space 52. Or, said another way, nothing causes hanger 26 to get hung-up on the upper end 50 of hook member 30.

As such, once hanging object 12 is lowered onto hook member 30, hanger 26 is received by hook member 30. That is, hanger 26 hangs by the force of gravity upon the upper surface 54 of hook member 30 within receiving space 52. In this arrangement, hanger 26 is securely held under the force of gravity and hanging object 12 is prevented from falling off of or out of receiving space 52. In this position, the weight of hanging object 12 is supported by object hanging system 10 which transitions this weight to wall 14.

Once hanger 26 is positioned securely within receiving space 52, and hanger 26 hangs upon the upper surface 54 of hook member 30, flexible member 34 may be moved to a retracted position or a rest position wherein the flexible member 34 is fully hidden behind the hanging object 12.

To accomplish this, flexible member 34 is forced downward within guide opening 32 either by pushing tip 60 or a portion of body 58 downward, or by pulling head 62 or a portion of body 58 downward. This downward movement occurs with greater force than the force of friction between guide opening 32 and flexible member 34.

This downward movement of flexible member 34 continues until the desired position of flexible member 34 is achieved (a rest position which is any stopping point between a fully extended position and a fully retracted position). In this rest position the flexible member 34 extends upward from hook member 30 slightly, but not so much so that it is visible. Or, said another way, flexible member 34 is hidden behind hanging object 12.

Alternatively, flexible member 34 may be fully removed from hook member 30 and guide opening 32. Removal of flexible member 34 may be desirable for example, if a portion of flexible member is visible after hanging object 12 is hung. As one example, hanging object 12 may be a floating frame having a transparent center section through which flexible member 34 is visible. In which case, removal of flexible member 34 may be desirable.

This arrangement makes for a simple, easy, safe and secure manner of installation of a hanging object 12 to a wall 14. As such, all of the objectives are met.

Symmetric:

In the arrangement shown, as one example, object hanging system 10 is generally symmetric in shape along a vertically extending axis that extends through the center of side 24 and opposing side 24 and through the center of the front side 20 and rear side 22 of main object hanging system 10. This symmetric arrangement provides balance to object hanging system 10.

Figure 2:
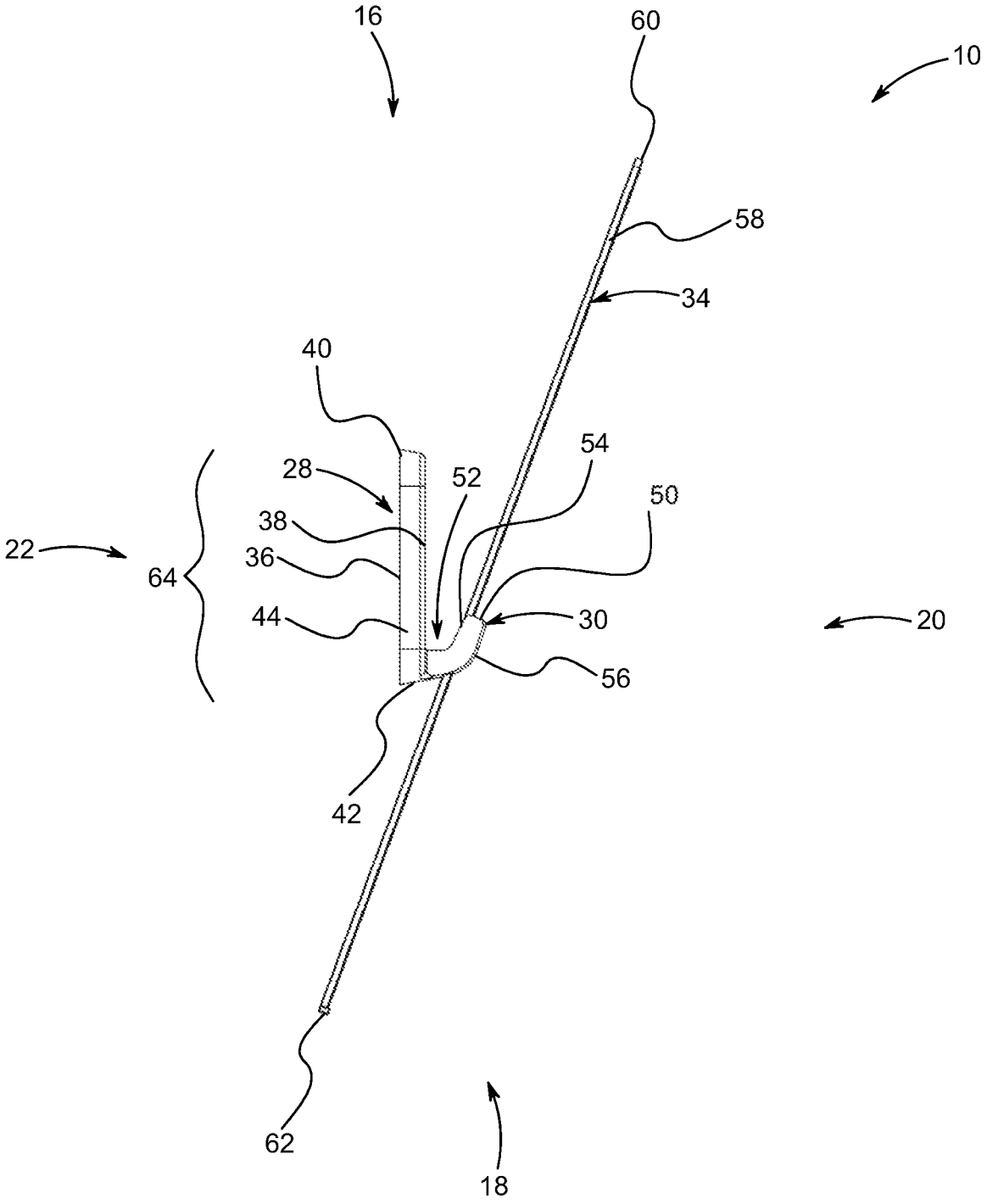
FIG. 2 shows a right side view of an object hanging system, in accordance with one or more embodiments.
Figure 3:
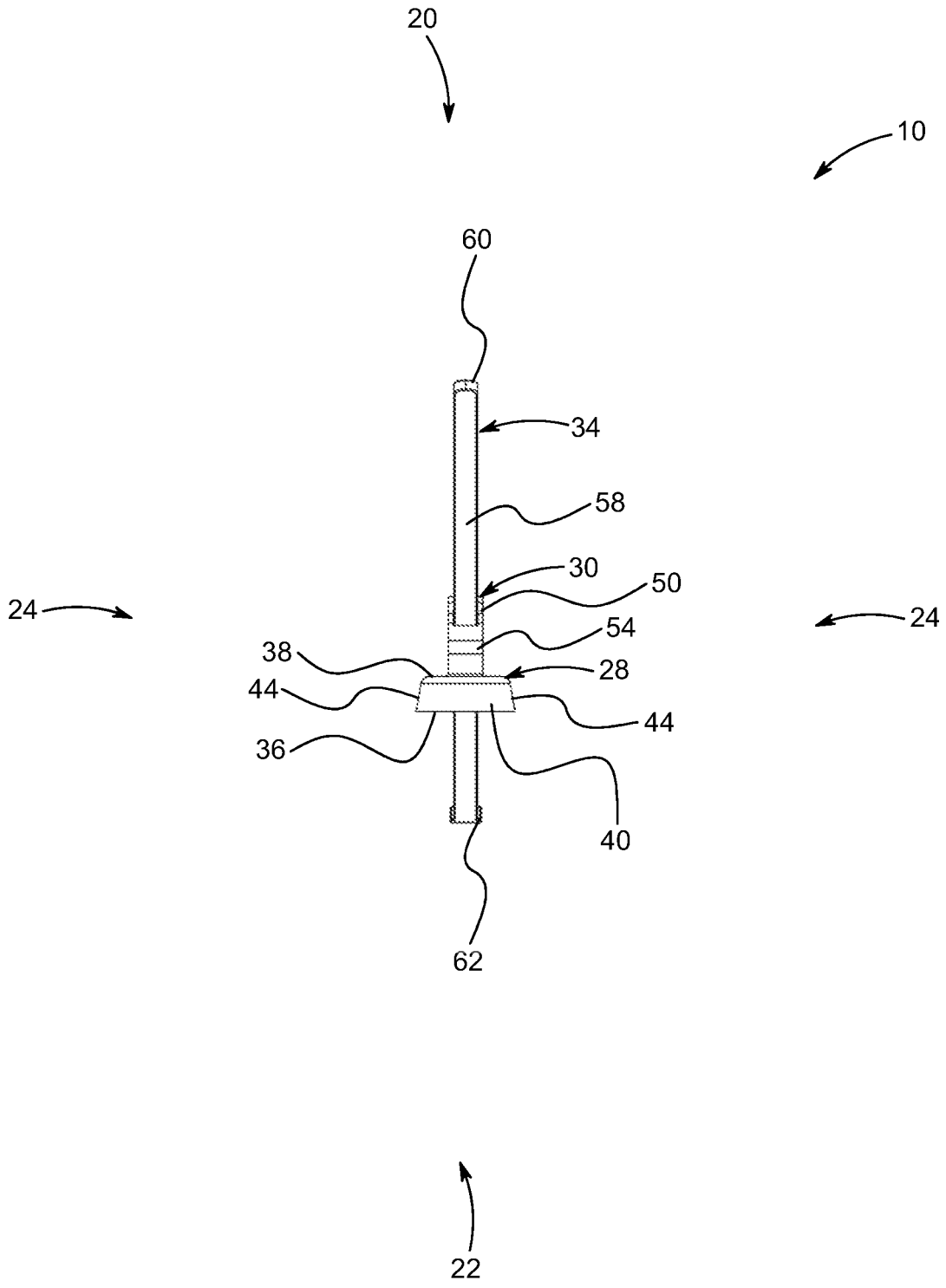
FIG. 3 shows a top view of an object hanging system, in accordance with one or more embodiments.
Figure 4:
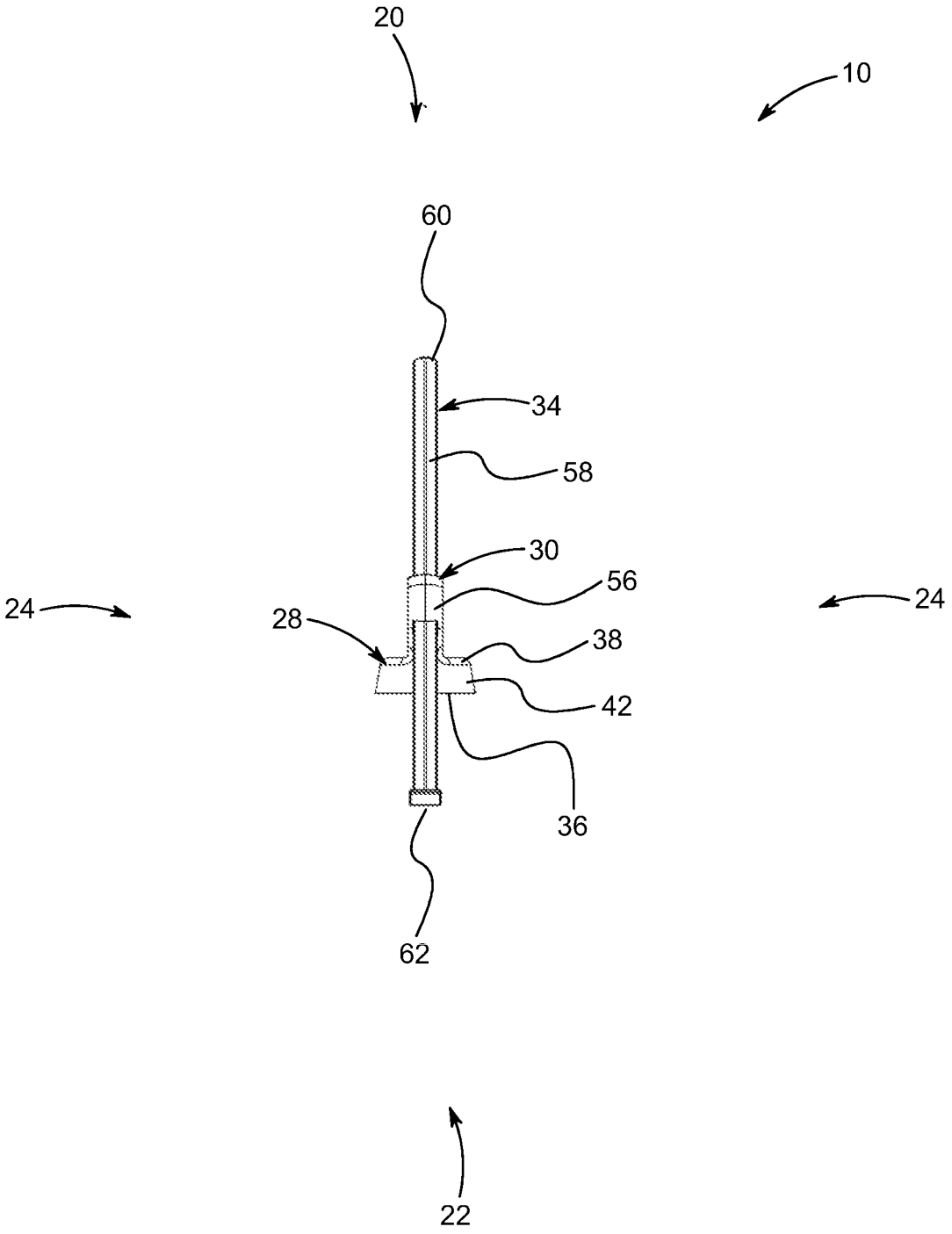
FIG. 4 shows a bottom view of an object hanging system, in accordance with one or more embodiments.
Figure 5:
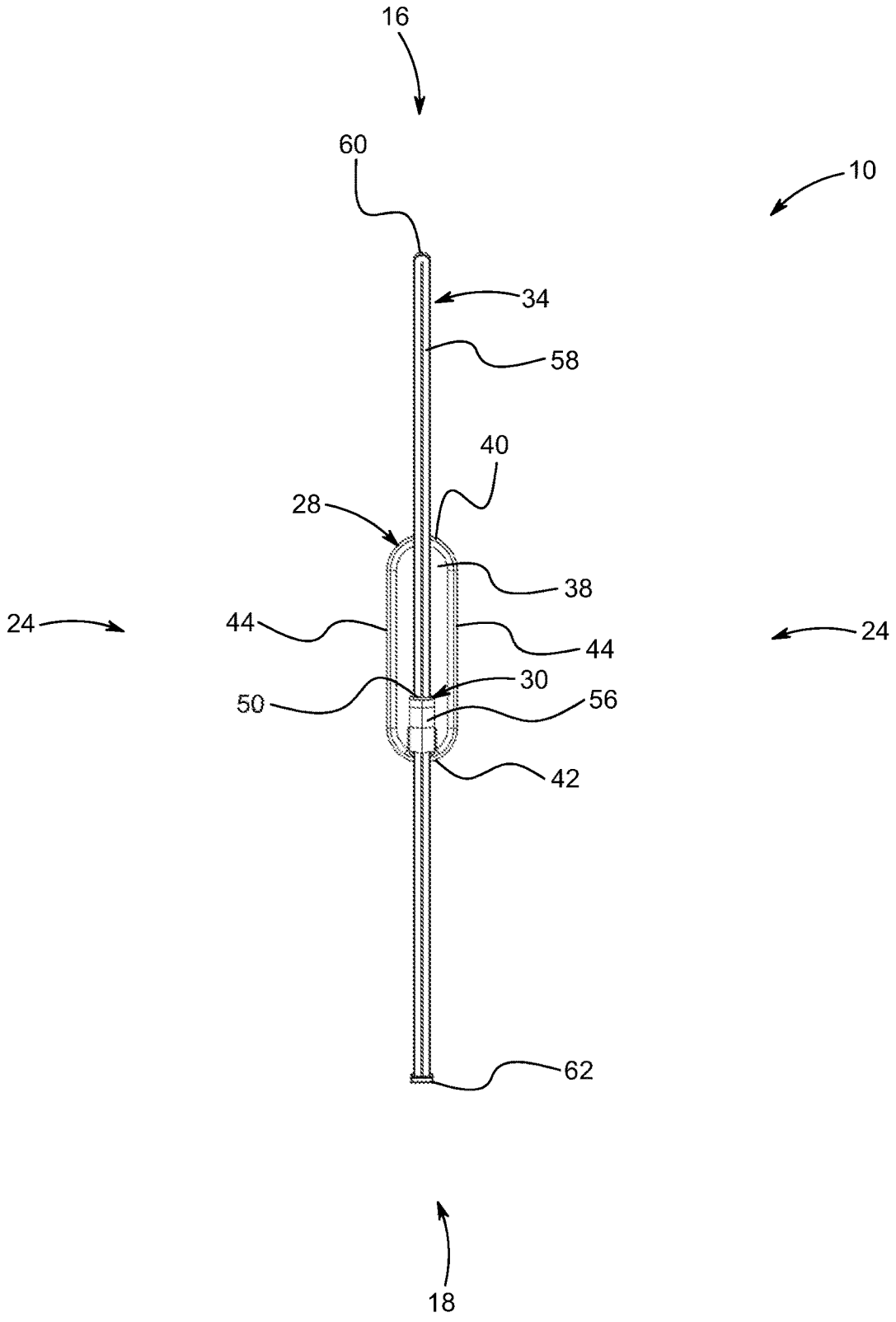
FIG. 5 shows a front view of an object hanging system, in accordance with one or more embodiments.
Figure 6:
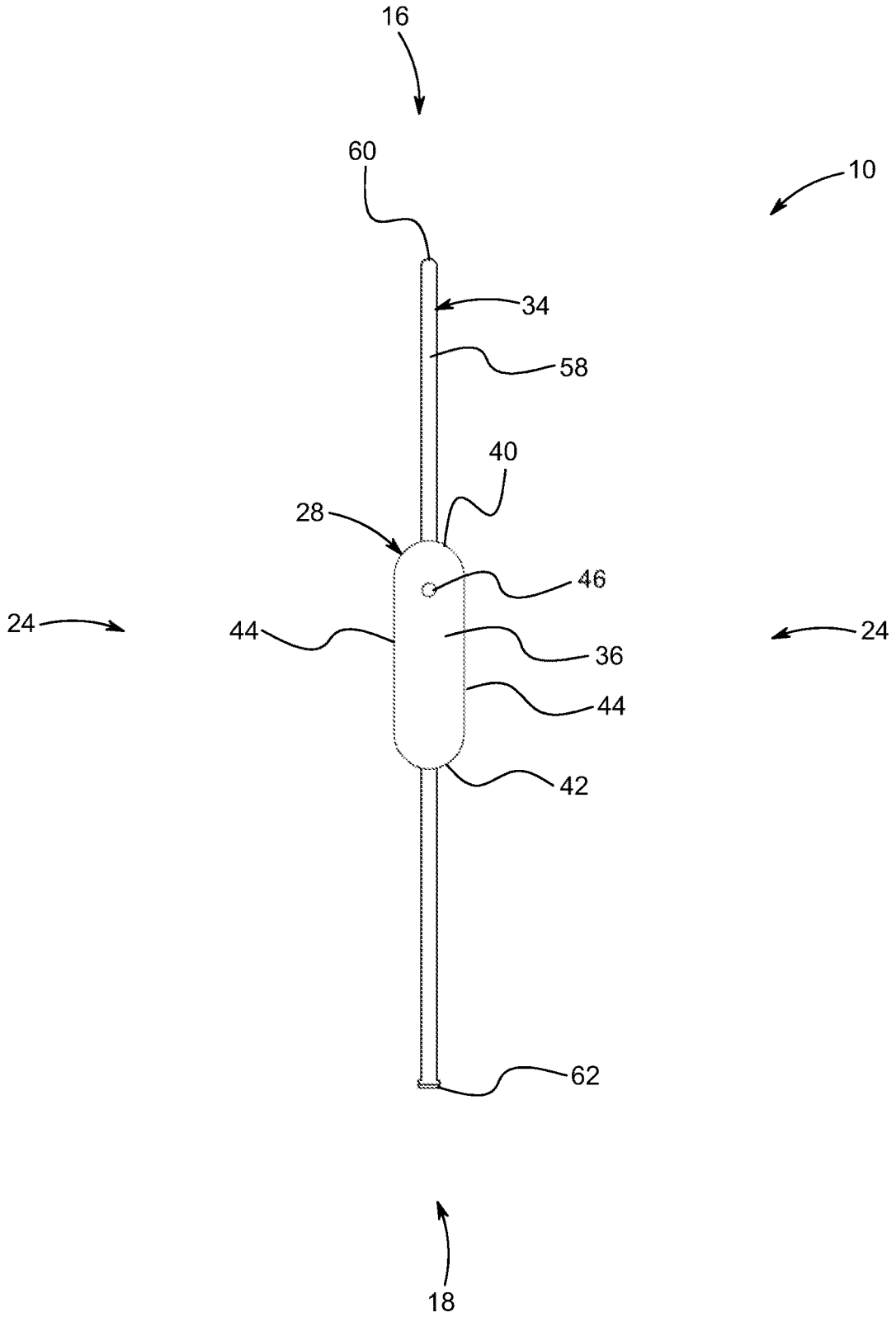
FIG. 6 shows a rear view of an object hanging system, in accordance with one or more embodiments.
Figure 7:
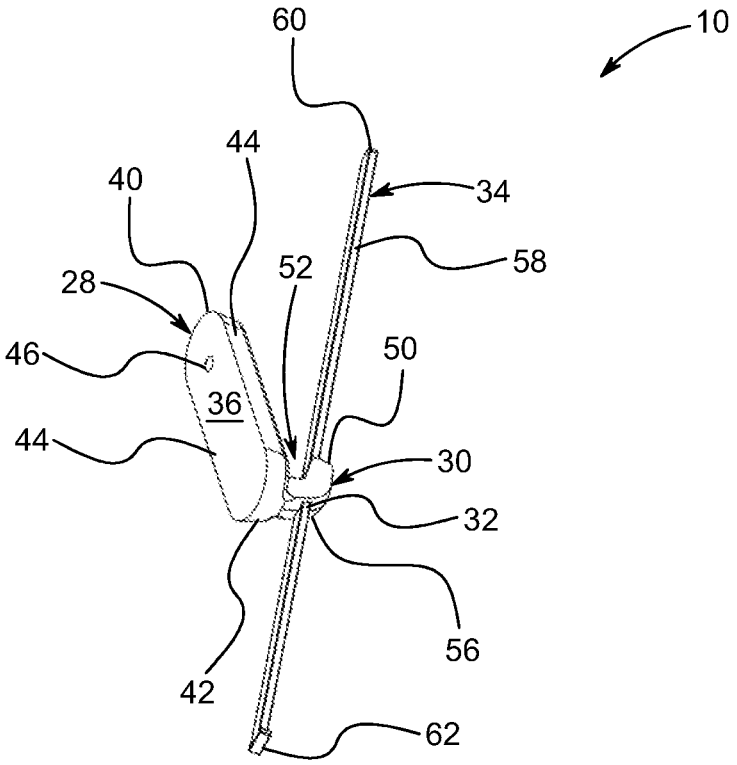
FIG. 7 shows a lower rear right side perspective view of an object hanging system, in accordance with one or more embodiments.
Figure 8:
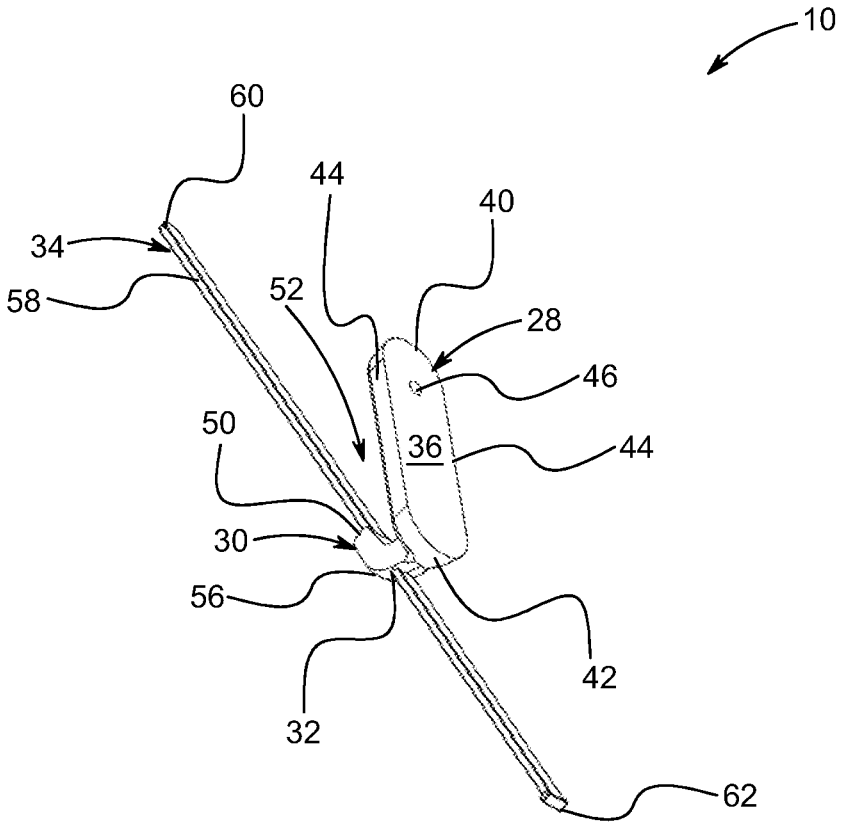
FIG. 8 shows a lower rear left side perspective view of an object hanging system, in accordance with one or more embodiments.
Figure 9:
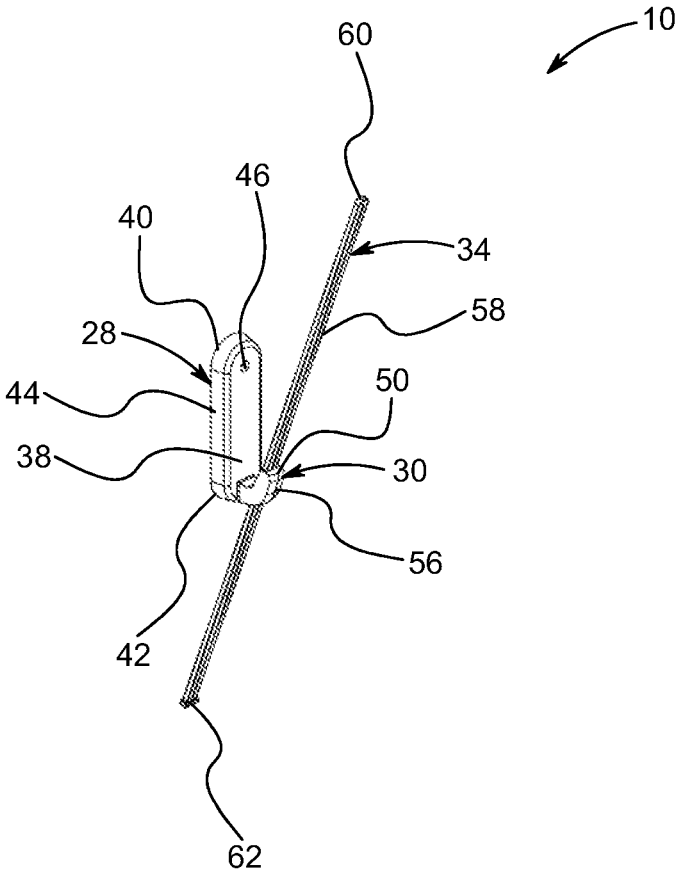
FIG. 9 shows an upper front right side perspective view of an object hanging system, in accordance with one or more embodiments.
Figure 10:
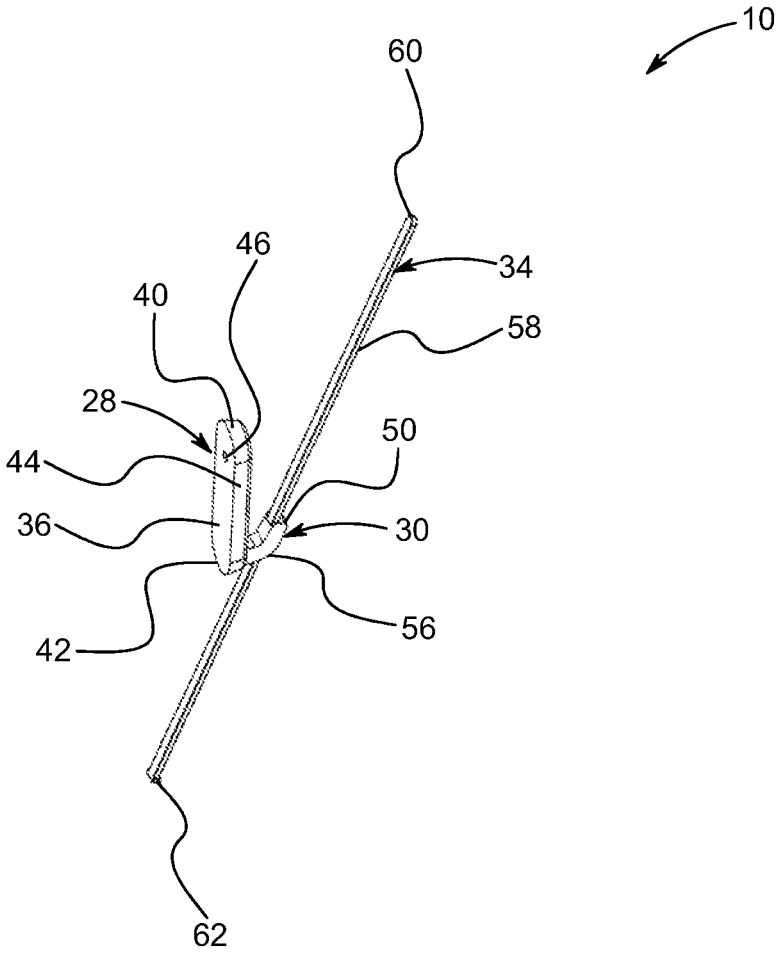
FIG. 10 shows an upper rear right side perspective view of an object hanging system, in accordance with one or more embodiments.
Figure 11:
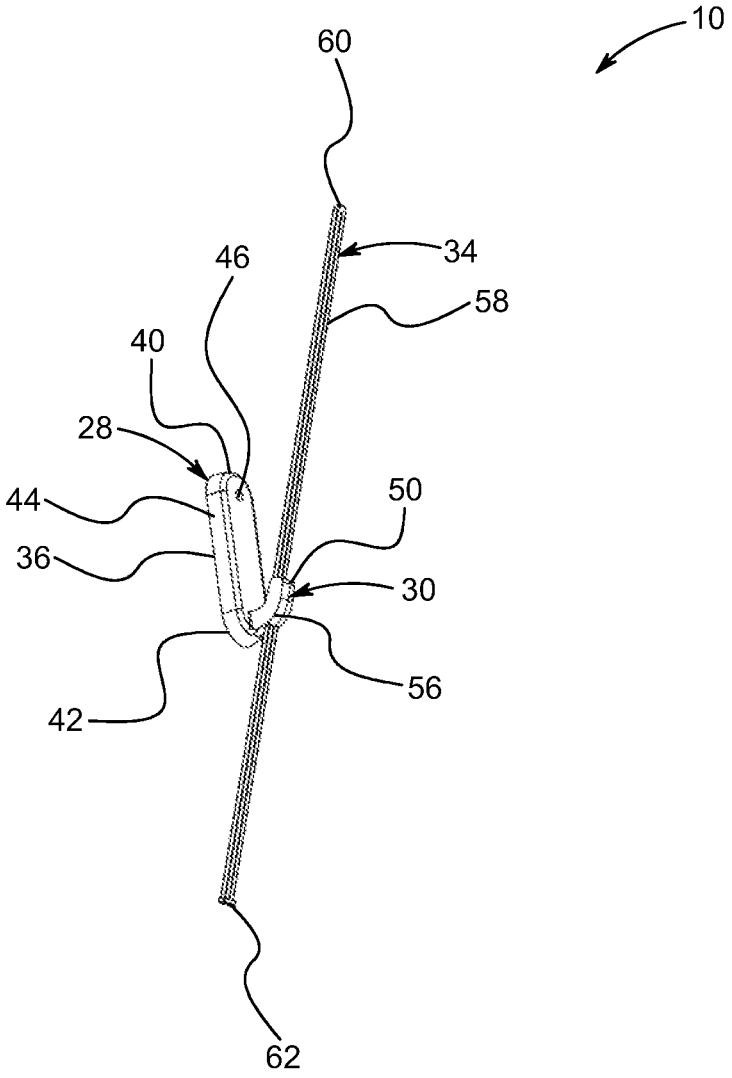
FIG. 11 shows a lower front right side perspective view of an object hanging system, in accordance with one or more embodiments.
Figure 12:
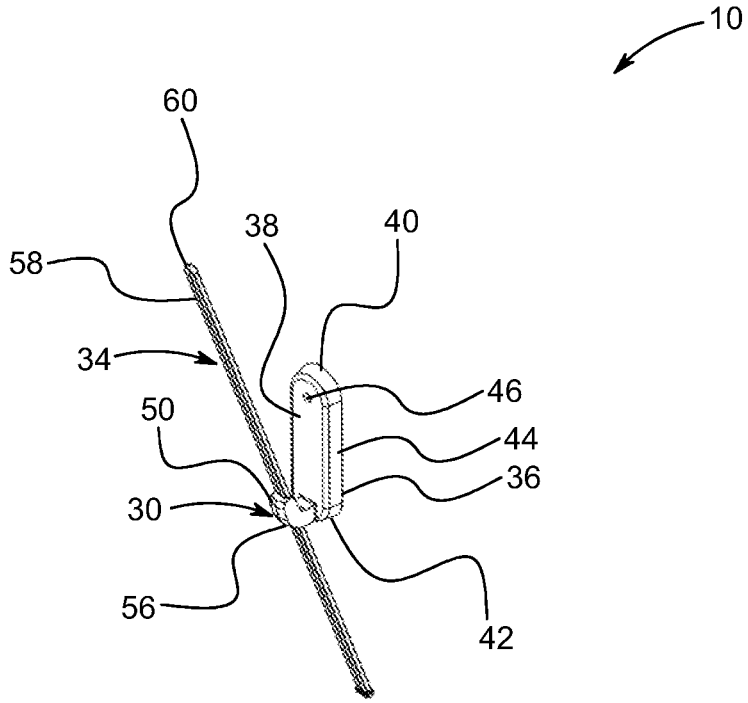
FIG. 12 shows an upper front left side perspective view of an object hanging system, in accordance with one or more embodiments.
Figure 13:
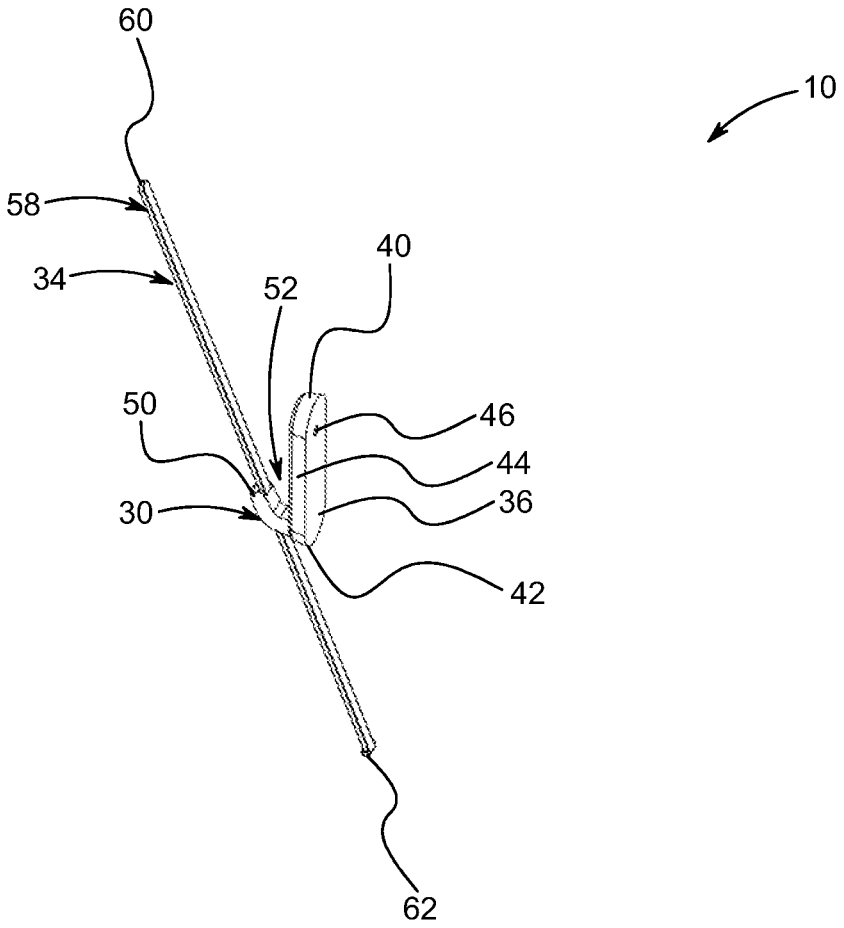
FIG. 13 shows an upper rear left side perspective view of an object hanging system, in accordance with one or more embodiments.

Alternative Arrangement—Sheet Metal Configuration:

In the arrangement shown, as one example, with reference to FIGS. 1-13, a formed body configuration of object hanging system 10 is presented. In this arrangement, object hanging system 10 is generally formed of a molded or machined component such as through injection molding, casting or the like. This configuration lends itself well to forming object hanging system 10 out of plastic or another non-metallic material.

Figure 14:
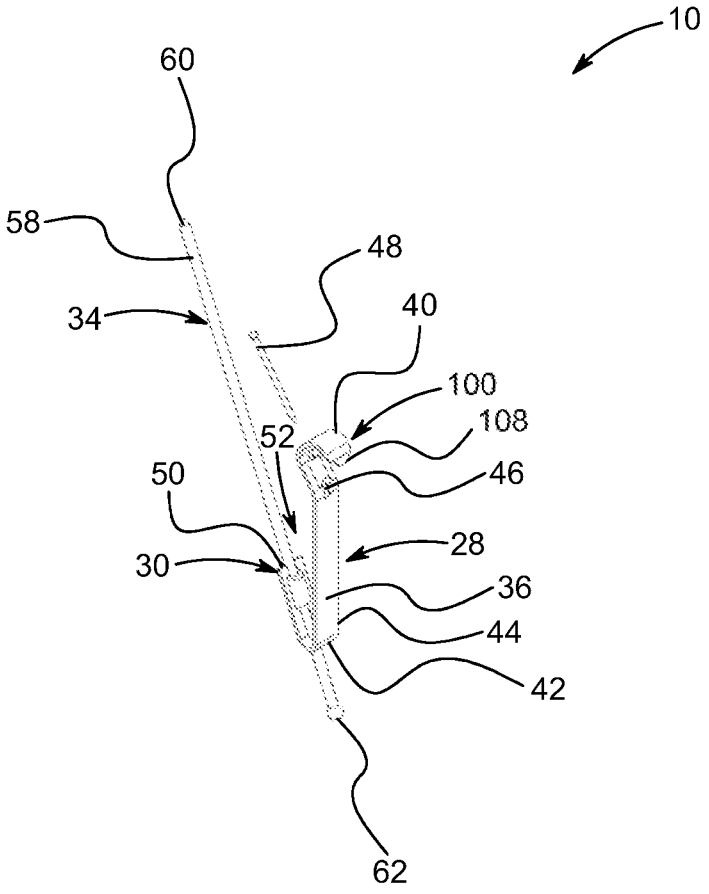
FIG. 14 shows an upper rear left side perspective view of an object hanging system, in accordance with one or more embodiments.
Figure 15:
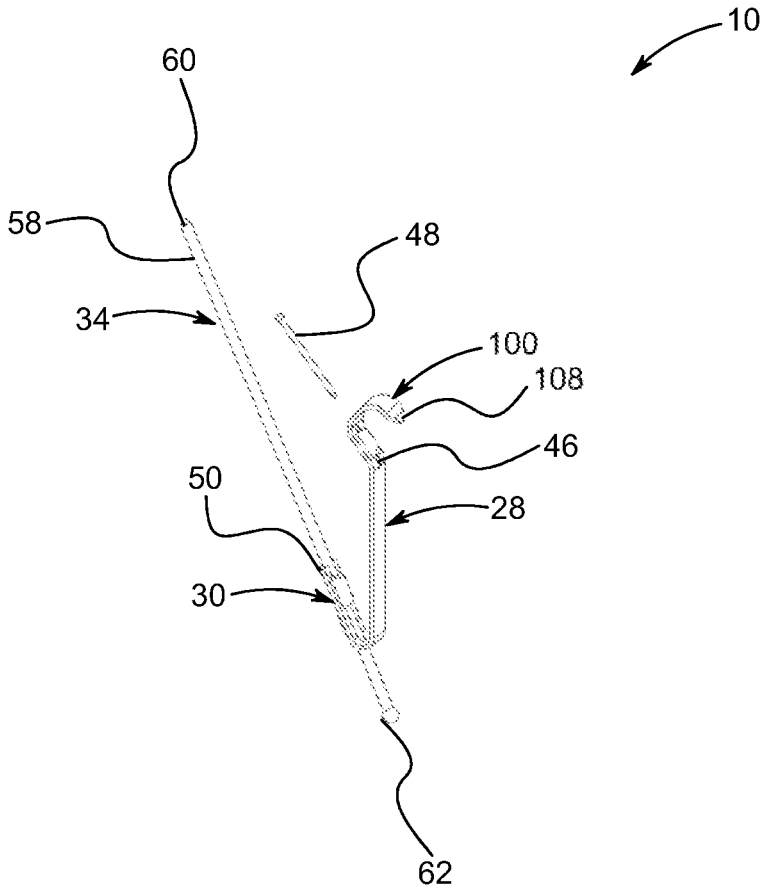
FIG. 15 shows an upper rear left side perspective view of an object hanging system, in accordance with one or more embodiments.
Figure 16:
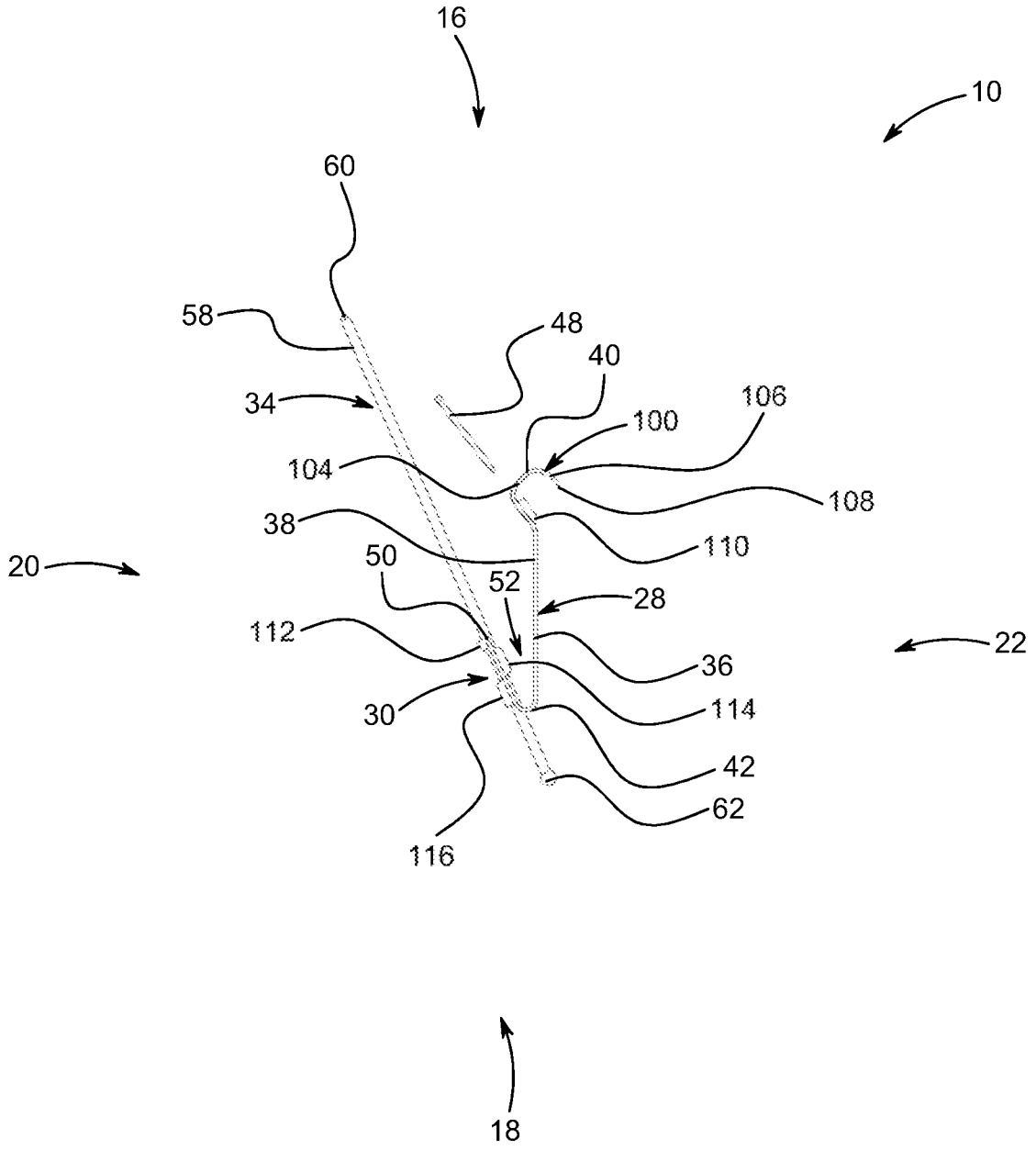
FIG. 16 shows a left side view of an object hanging system, in accordance with one or more embodiments.
Figure 17:
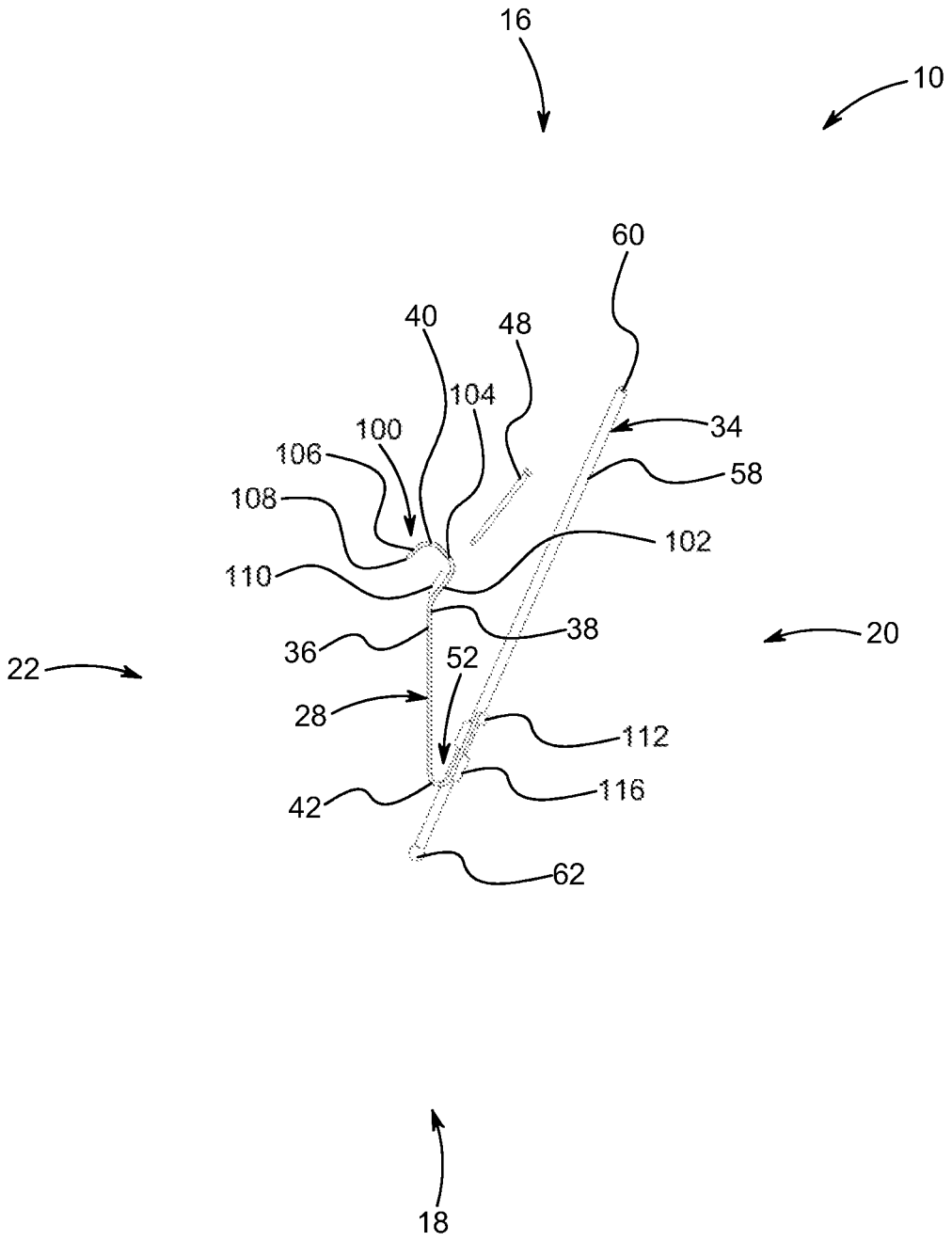
FIG. 17 shows a right side view of an object hanging system, in accordance with one or more embodiments.
Figure 18:
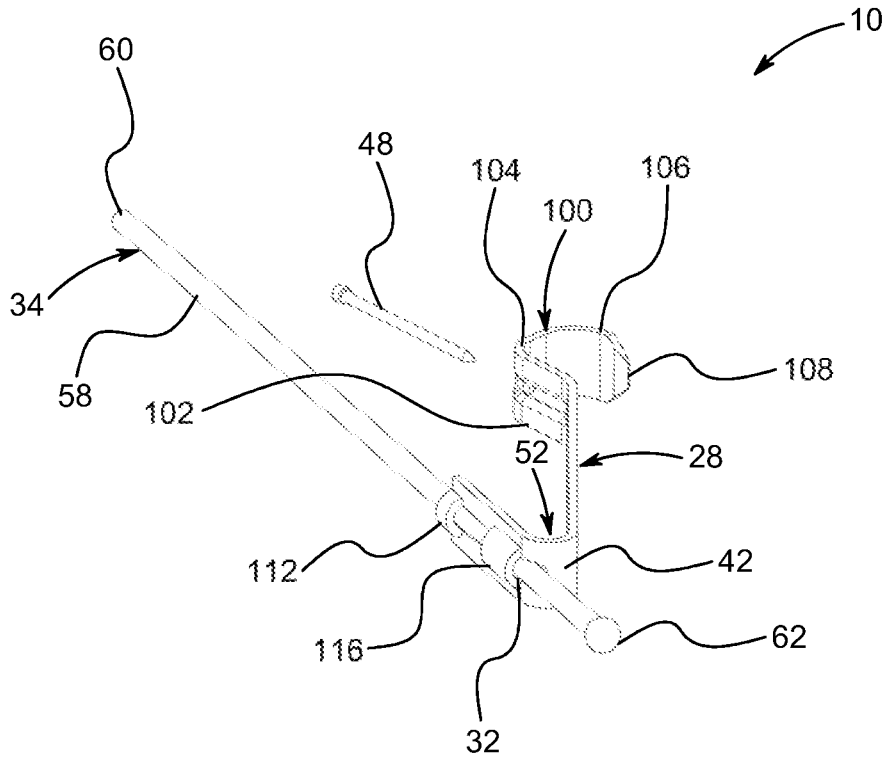
FIG. 18 shows a lower left side perspective view of an object hanging system, in accordance with one or more embodiments.
Figure 19:
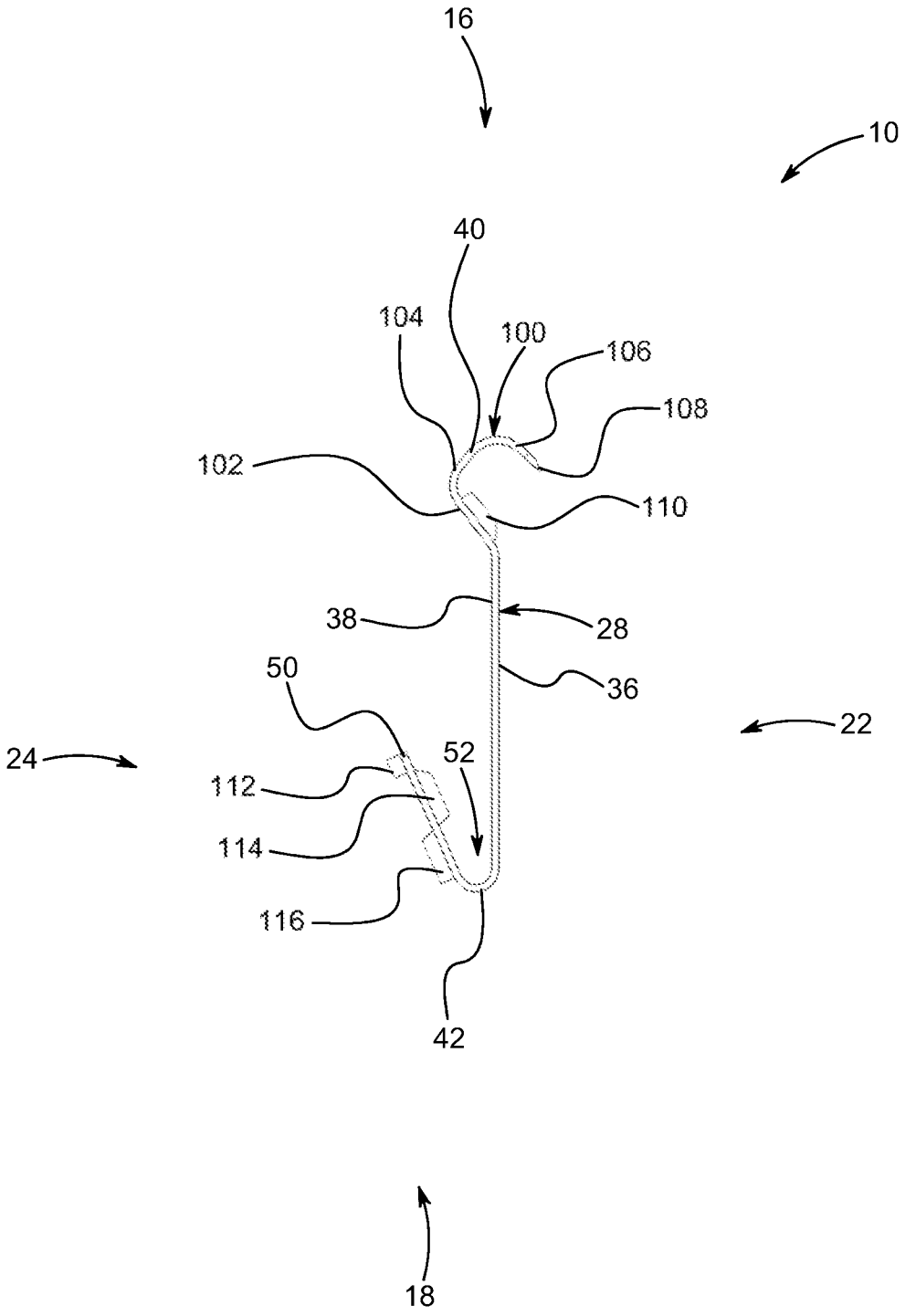
FIG. 19 shows a left side view of an object hanging system, in accordance with one or more embodiments.
Figure 20:
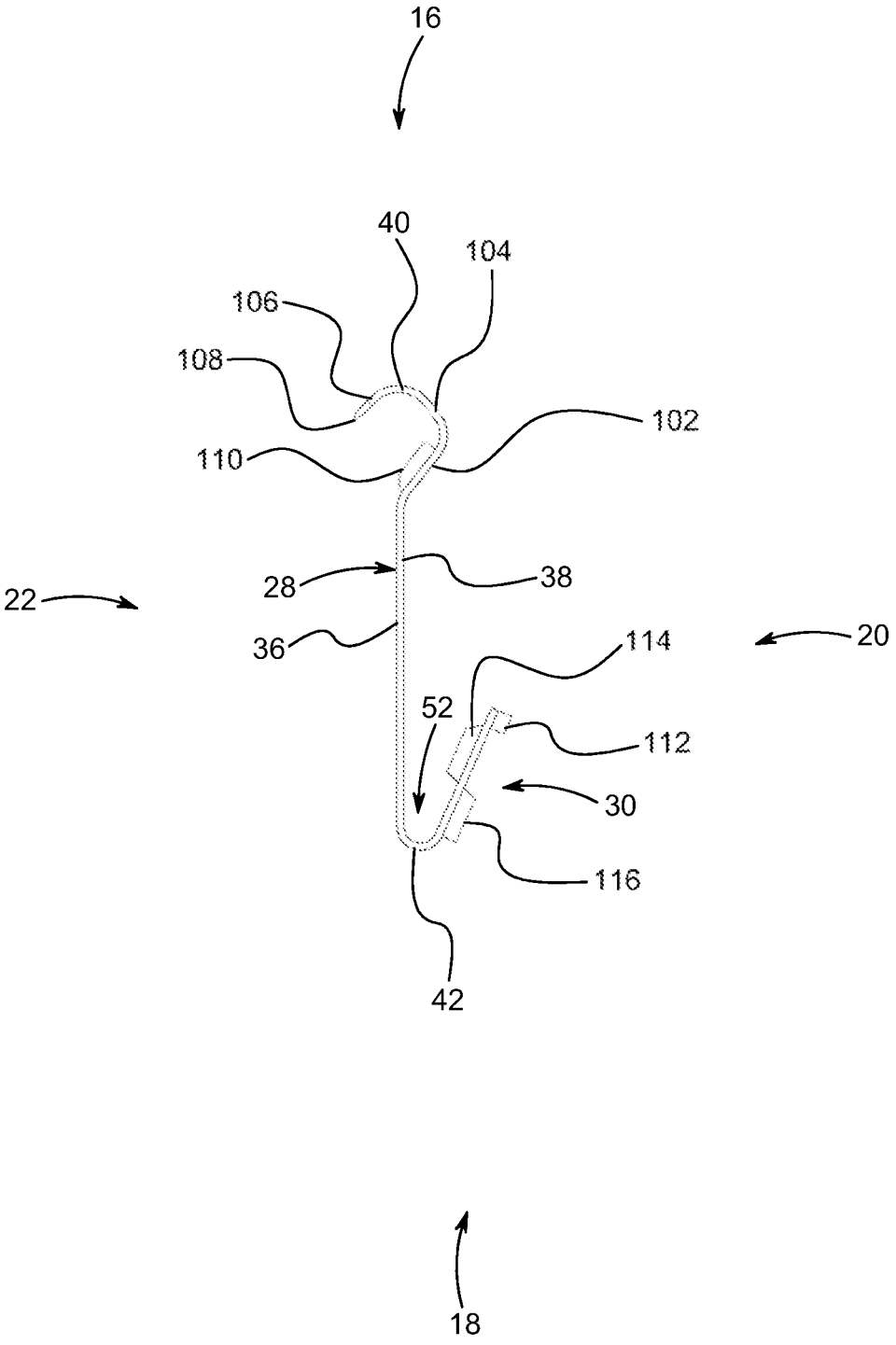
FIG. 20 shows a left side view of an object hanging system, in accordance with one or more embodiments.
Figure 21:
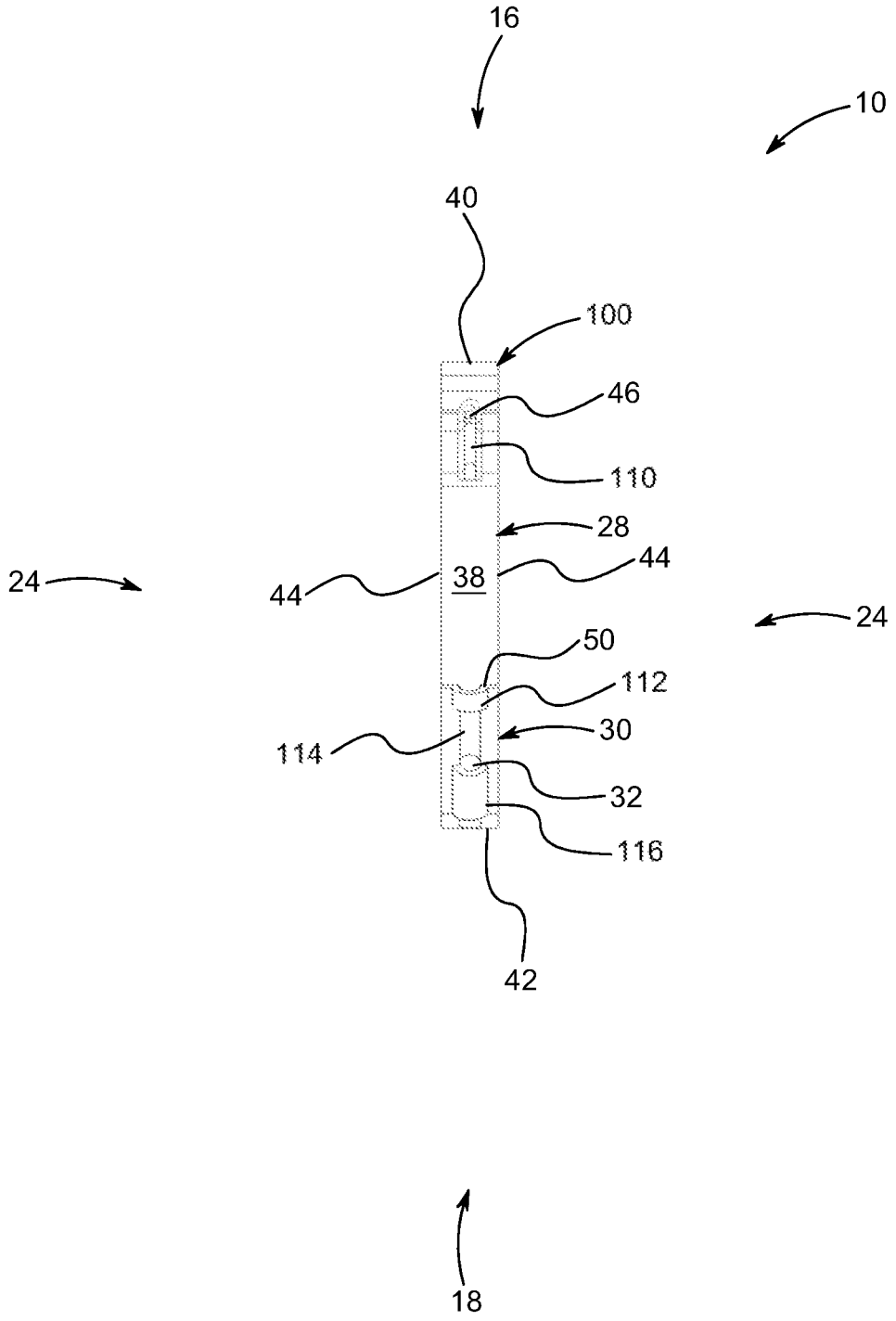
FIG. 21 shows a front view of an object hanging system, in accordance with one or more embodiments.
Figure 22:
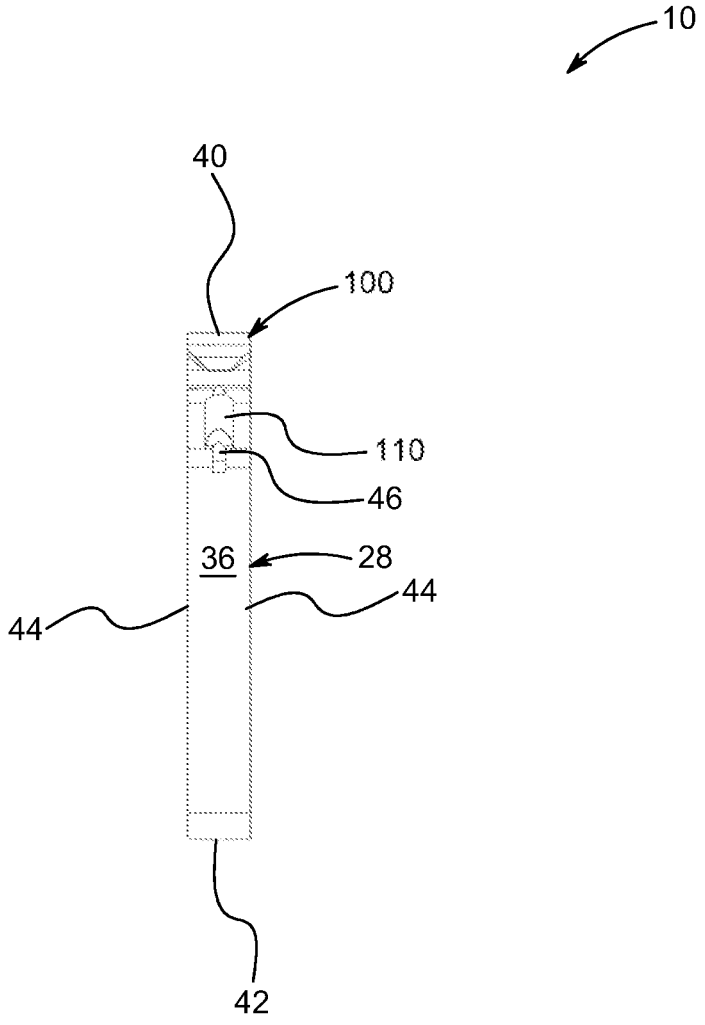
FIG. 22 shows a rear view of an object hanging system, in accordance with one or more embodiments.
Figure 23:
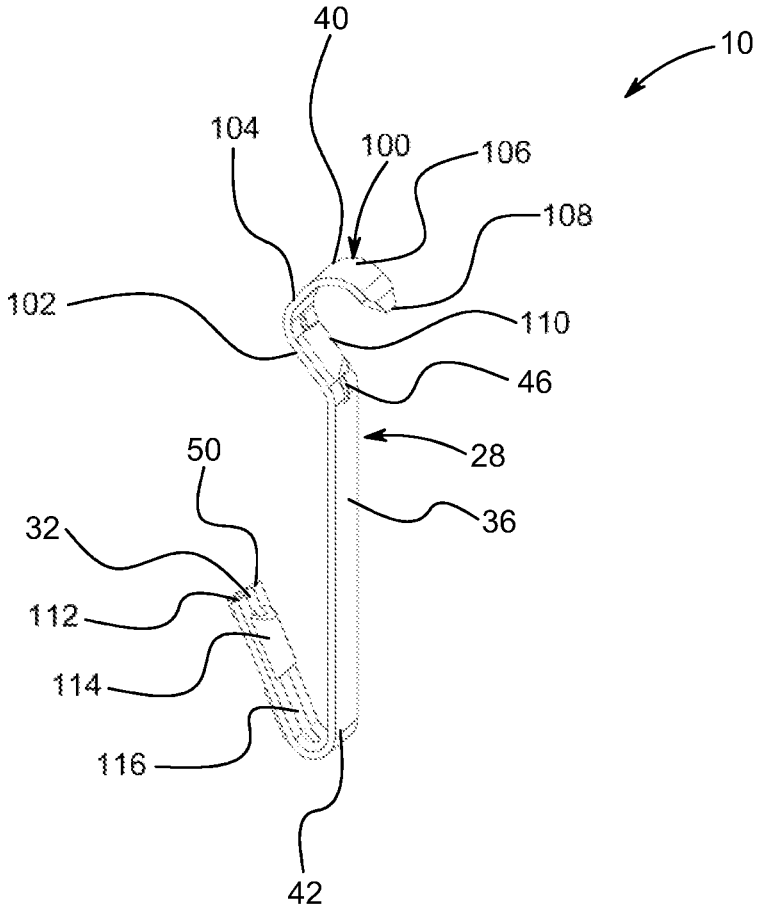
FIG. 23 shows an upper rear left side perspective view of an object hanging system, in accordance with one or more embodiments.
Figure 24:
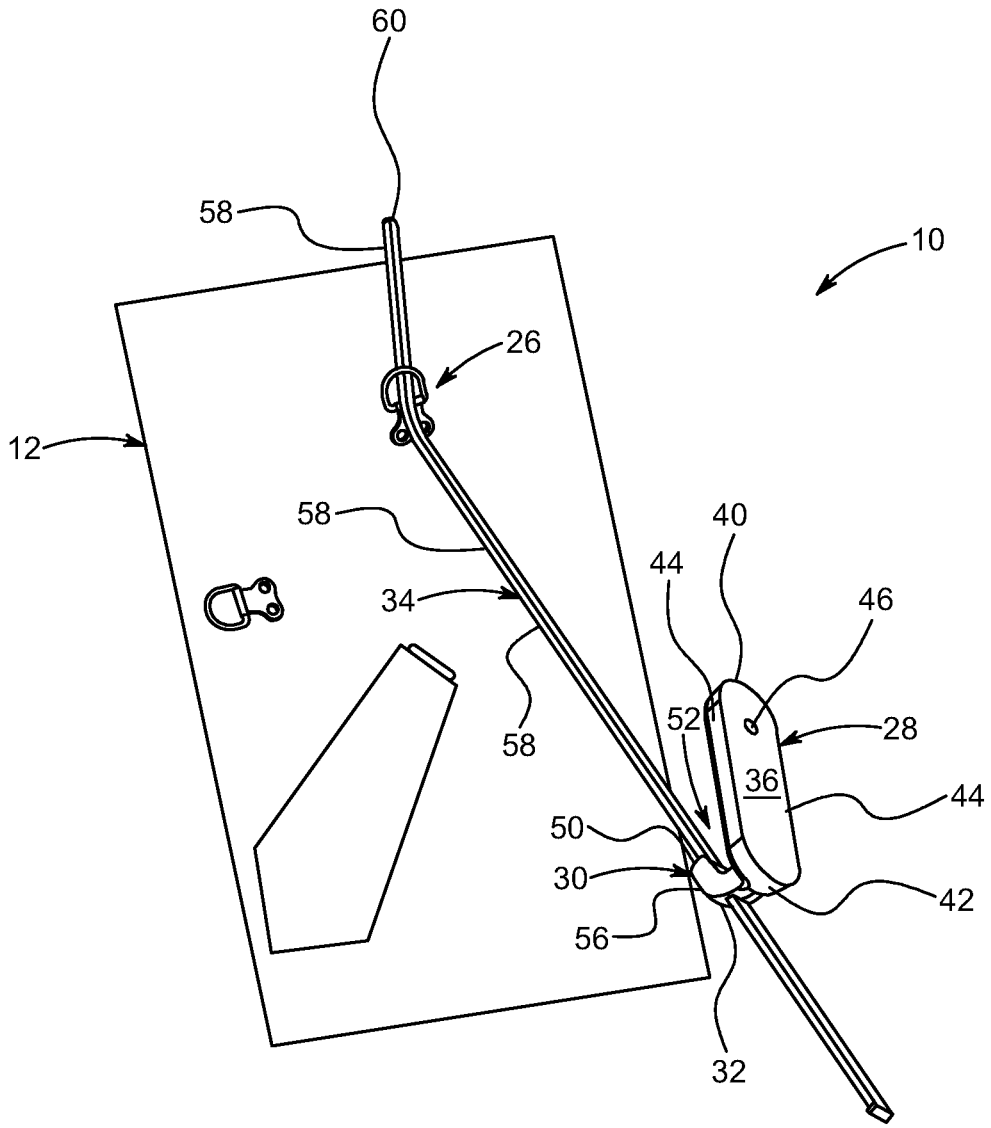
FIG. 24 shows a lower rear left side perspective view of an object hanging system and hanging object, in accordance with one or more embodiments; the view showing a hanger of the hanging object being guided to the hook member of the object hanging system by a flexible member.

In an alternative arrangement, as another example, with reference to FIGS. 14-26, an alternative configuration of object hanging system 10 is presented. In this configuration, the body of object hanging system 10 is generally formed of a metallic material that is formed through a bending, casting and/or machining process.

This alternative configuration may be referred to herein as a sheet metal configuration. However, this alternative configuration is not limited to being used with sheet metal per se. Instead, the term sheet metal used herein is simply used to define a main body of object hanging system 10 that is formed out of a single continuous member that may be formed metal or may be made primarily out of a metal or metal alloy.

In this arrangement, the main body of object hanging system 10 is formed of a single continuous metallic member that is cut and/or bent to form the desired shape. This arrangement is similar to the previously-presented arrangement and therefor, unless stated specifically otherwise, the teaching of the previously presented arrangement applies equally to this alternative arrangement.

Hook Member 100:

In this alternative arrangement, object hanging system 10 includes wall attachment member 28 that is generally flat and planar in shape. One difference is that wall attachment member 28 includes a hook member 100 positioned at the upper end of wall attachment member 28. In the arrangement shown, as one example, when viewed from a side 24, hook member 100 extends upward and forward from the upper end of the generally flat plane of wall attachment member 28 in a first section 102. Then, hook member 100 extends upward and slightly rearward at an angle in a second section 104. Then, hook member 100 extends downward and slightly rearward in a third section 106 before terminating in a point 108. In the arrangement shown, as one example, first section 102 and third section 106 extend in approximate parallel planar spaced alignment to one another. In the arrangement shown, as one example, second section 104 extends in approximate perpendicular planar alignment to first section 102 and third section 106. However, any other configuration is hereby contemplated for use as hook member 100.

In the arrangement shown, as one example, the end of hook member 100 terminates in a point 108 that is configured to be driven into wall 14 thereby helping to secure object hanging system 10 to wall 14. This point may be referred to as a chisel. In the event that a downward force was applied to object hanging system 10, point 108 would dig into wall 14 thereby helping to prevent further downward movement of object hanging system 10 which adds security, robustness and strength. However, in an alternative arrangement, point 108 is not present and therefore hook member 100 does not penetrate wall 14.

In this arrangement, opening 46 of wall attachment member 28 is present in first section 102 of hook member 100. In this arrangement, to facilitate alignment of fastener 48, opening 46 is formed by inwardly pressing a section of first section 102 to form a collar 110 that is positioned on one side of fastener 48 when fastener 48 is inserted through opening 46. In the arrangement shown, as one example, portions of first section 102 on the upper side and lower side of collar 110 are positioned on the opposite side of fastener 48. In this way, fastener 48 is captured within opening 46 by portions of object hanging system 10 on either side of fastener 48 and/or surrounding fastener 48.

Hook Member 30:

In this alternative arrangement, in the arrangement shown, as one example, the lower end of wall attachment member 28 connects to hook member 30. In the arrangement shown, as one example, when viewed from a side 24, hook member 30 initially curves outward and around before extending in a generally straight section that extends upward and outward before terminating in end 50. In this arrangement, hook member 30 includes guide opening 32. Guide opening 32 is configured to receive flexible member 34 therein.

In the arrangement shown, as one example, guide opening 32 is formed of a first collar 112, a second collar 114 and a third collar 116 that help to guide flexible member 34 through guide opening 32. In the arrangement shown, as one example, first collar 112 extends outward from the outward or lower surface 56 of hook member 30 at or near the outward end 50 of hook member 30. In the arrangement shown, as one example, second collar 114 extends inward from the inward or upper surface 54 of hook member 30 at or near the middle of hook member 30 and between first collar 112 and third collar 116. In the arrangement shown, as one example, third collar 116 extends outward from the outward or lower surface 56 of hook member 30 at or near the lower end of hook member 30.

In this way, first collar 112, second collar 114 and third collar 116 are pressed outward from the generally planar member that forms hook member 30 thereby forming guide opening 32 that allows flexible member 34 to extend there through. In the arrangement shown, as one example, when flexible member 34 is present within guide opening 32, second collar 114 is on the upper side of flexible member 34 while first collar 112 and third collar 116 are on the lower side of flexible member 34.

In the arrangement shown, as one example, as flexible member 34 extends through guide opening 32, first collar 112, second collar 114 and third collar 116 apply the desired amount of friction upon flexible member 34 that helps to hold flexible member 34 in a rest position while allowing the user to selectively move the flexible member 34 to any other position between a fully extended position to a fully retracted position by applying a force that is greater than the force of friction between flexible member 34 and guide opening 32.

In the arrangement shown, due to the manner of pressing first collar 112, second collar 114 and third collar 116 guide opening 32 is generally circular in cross sectional shape and as such flexible member 34 is similarly generally circular in cross sectional shape.

In the arrangement shown, as one example, the upper forward end of second collar 114 is angled slightly, chamfered, smoothed or otherwise reduced so as to prevent hanger 26 of hanging object 12 from getting hung upon the leading edge of second collar 114 upon insertion into receiving space 52. That is, when viewed from the side, the upper forward end of second collar 114 angles downward and rearward in comparison to the generally flat plane of hook member 30. This downward and rearward angle of second collar 114 helps to guide hanger 26 into receiving space 52 and prevent hanger 26 from hanging on the leading edge of second collar 114.

Objectives Met:

From the above discussion it will be appreciated that the improved object hanging system 10 and related methods of use, presented herein improves upon the state of the art.

Specifically, the improved object hanging system and related methods of use presented: allows secure mounting of objects to a supporting surface; reduces installation time; allows quick installation; prevents damage due to improper installation of wall hanging objects; prevents injury due to improper installation of wall hanging objects; is easy to use; is cost effective; is inexpensive; is intuitive to use; can be used with practically any hanging object; eliminates guesswork when installing hanging objects to a wall; is safer than presently available alternatives; is robust; has a long useful life; can be used multiple times; is fully concealed behind the hanging object; and/or is adjustable in nature, among countless other advantages and improvements.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the invention. It is intended that this invention be limited only by the following claims, and the full scope of equivalents thereof.

What is claimed:

1. An object hanging system, comprising:

a wall attachment member;

the wall attachment member configured to be secured to a wall;

the wall attachment member having a hook member;

the wall attachment member having a guide opening;

a flexible member;

the flexible member configured to extend through the guide opening of the wall attachment member;

the flexible member configured to slide with respect to the guide opening while extending through the guide opening to move between a fully extended position and a fully retracted position;

wherein when the wall attachment member is connected to a wall and the flexible member is in the fully extended position, the flexible member is configured to be inserted into and extended through a hanger of an object; and guide the hanger along the flexible member to the hook member while the flexible member is inserted into and extended through the hanger to facilitate placement of the hanger onto the hook member of the wall attachment member, thereby hanging the object from the hook member.

2. The object hanging system according to claim 1, wherein when the flexible member is in a fully retracted position, the flexible member is configured to be hidden behind an object connected to the hook member.

3. The object hanging system according to claim 1, wherein the flexible member extends a length between a tip and a head, wherein the head is larger than the guide opening and cannot pass through the guide opening.

4. The object hanging system according to claim 1, wherein the flexible member has a body that extends a length between a tip and a head, wherein the body has a generally cylindrical, generally rectangular, generally square, or generally triangular cross sectional shape.

5. The object hanging system according to claim 1, wherein the guide opening facilitates sliding of the flexible member through the guide opening between the fully extended position and the fully retracted position.

6. The object hanging system according to claim 1, wherein the guide opening facilitates frictional holding of the flexible member at a rest position between a fully extended position and a fully retracted position.

7. The object hanging system according to claim 1, wherein the wall attachment member is formed of plastic.

8. The object hanging system according to claim 1, wherein the wall attachment member is formed of metal.

9. The object hanging system according to claim 1, wherein the object is formed of plastic shadow boxes, mirrors or any other hanging object.

10. The object hanging system according to claim 1, wherein the flexible member is formed of metal.

11. The object hanging system according to claim 1, wherein the wall attachment member is secured to a wall using adhesive.

12. The object hanging system according to claim 1, wherein the wall attachment member is secured to a wall using a fastener.

13. The object hanging system according to claim 1, wherein at least one end of the flexible member includes a stopping member.

14. The object hanging system according to claim 1, wherein the flexible member is removable from the wall attachment member.

15. The object hanging system according to claim 1, wherein the object is a picture frame.

16. The object hanging system according to claim 1, wherein the wall attachment member and the hook member are formed of a single monolithic and unitary continuous member.

17. The object hanging system according to claim 1, wherein the wall attachment member and the flexible member are mutually exclusive components.

18. The object hanging system according to claim 1, wherein the flexible member is more flexible than the wall attachment member.

19. The object hanging system according to claim 1, wherein when the wall attachment member is connected to the wall, the wall attachment member and the hook member both remain stationary when the flexible member is moved between the fully extended position and the fully retracted position.

20. The object hanging system according to claim 1, wherein when the wall attachment member is connected to the wall and the flexible member is in the fully extended position, an outward end of flexible member is movable to several positions while the wall attachment member and the hook member both remain stationary to facilitate insertion of the flexible member into and through the hanger.

21. The object hanging system according to claim 1, wherein when the wall attachment member is connected to the wall and the flexible member is in the fully extended position, an outward end of flexible member is movable while the wall attachment member remains stationary to facilitate insertion of the flexible member into and through the hanger.

22. The object hanging system according to claim 1, wherein when the wall attachment member is connected to the wall, the hook member extends out from the wall a first distance;

wherein when the wall attachment member is connected to the wall and the flexible member is in the fully extended position, the flexible member is configured to be inserted into and extended through the hanger while the hanger is positioned at a second distance from the wall;

wherein the second distance is greater than the first distance.

23. The object hanging system according to claim 1, wherein the guide opening is a hole extending through the hook.

24. The object hanging system according to claim 1, wherein the wall attachment member and the hook member are formed of a single monolithic and unitary continuous member;

wherein the wall attachment member and the flexible member are mutually exclusive components;

wherein the flexible member is formed of a first material and the wall attachment member is formed of a second material;

wherein the first material is more flexible than the second material;

wherein when the wall attachment member is connected to the wall and the flexible member is moved between the fully extended position and the fully retracted position, the wall attachment member and the hook member remain stationary;

wherein when the wall attachment member is connected to the wall and the flexible member is in the fully extended position, an outward end of flexible member is movable to several positions while the wall attachment member remains stationary to facilitate insertion of the flexible member into and through the hanger;

wherein when the wall attachment member is connected to the wall and the flexible member is in the fully extended position, the outward end of flexible member is movable while the wall attachment member remains stationary;

wherein when the wall attachment member is connected to the wall, the hook member extends out from the wall a first distance;

wherein when the wall attachment member is connected to the wall and the flexible member is in the fully extended position, the flexible member is configured to be inserted into and extended through the hanger when the hanger is positioned at a second distance from the wall;

wherein the second distance is greater than the first distance;

wherein the guide opening is a hole extending through the hook.

25. A method of securing an object to a wall, the steps comprising:

providing a wall attachment member having a hook member and a flexible member that extends through a guide opening;

attaching the wall attachment member to the wall;

sliding the flexible member within the guide opening to an extended position;

placing a hanger of the object over the flexible member when the flexible member is in an extended position and extending the flexible member through the hanger;

while the flexible member is extended through the hanger, sliding the hanger of the object down the flexible member until the hanger is placed over the hook member, thereby hanging the object on the hook member;

sliding the flexible member, after the hanger of the object is placed over the hook member, to a retracted position wherein the flexible member is hidden behind the object.

26. The method of claim 25, wherein the step of attaching the wall attachment member to the wall is performed using a fastener that extends through the wall attachment member and into the wall.

27. The method of claim 25, wherein the step of attaching the wall attachment member to the wall is performed using an adhesive that adheres the wall attachment member onto the wall.

28. The method of claim 25, wherein the flexible member extends a length between a tip and a head, wherein the head is larger than the guide opening and cannot pass through the guide opening.

29. The method of claim 25, wherein the flexible member has a body that extends a length between a tip and a head, wherein the body has a generally cylindrical, generally rectangular, generally square or generally triangular cross sectional shape.

30. The method of claim 25, wherein the guide opening facilitates sliding of the flexible member through the guide opening between a fully extended position and a fully retracted position.

31. The method of claim 25, wherein the guide opening facilitates frictional holding of the flexible member at a rest position between a fully extended position and a fully retracted position.

32. The method of claim 25, wherein the wall attachment member is formed of plastic.

33. The method of claim 25, wherein the wall attachment member is formed of metal.

34. The method of claim 25, wherein the flexible member is formed of plastic.

35. The method of claim 25, wherein the flexible member is formed of metal.

36. The method of claim 25, wherein at least one end of the flexible member includes a stopping member.

37. The method of claim 25, wherein the flexible member is removable from the wall attachment member.

38. A object hanging system, comprising:

a wall attachment member;

the wall attachment member having a hook member;

the wall attachment member having a guide opening;

a flexible member;

the flexible member configured to be inserted into and extended though the guide opening of the wall attachment member;

the flexible member configured to be moved within the guide opening between an extended position and a retracted position;

wherein when the wall attachment member is connected to a wall and the flexible member is moved to the extended position, the flexible member extends outward from hook member so as to permit;

the flexible member is to be inserted into and extended through a hanger of a hanging object; and the hanger to be guided along the flexible member to the hook member while the flexible member is inserted into and extended through the hanger to facilitate alignment of the hanger with hook member and placement of the hanger onto the hook member, thereby hanging the object from the hook member.

* * * * *